US006082268A

United States Patent [19]

Lund

[11] Patent Number: 6,082,268

[45] **Date of Patent: *Jul. 4, 2000**

[54] SYSTEM FOR AUTOMATED TRANSPORT OF AUTOMOBILE PLATFORMS PASSENGER CABINS AND OTHER LOADS

[75] Inventor: VanMetre Lund, Northbrook, Ill.

[73] Assignee: Autran Corp., Evanston, Ill.

[ * ] Notice: This patent is subject to a terminal disclaimer.

[21] Appl. No.: 09/005,854

[22] Filed: Jan. 12, 1998

Related U.S. Application Data

[63] Continuation-in-part of application No. 08/746,318, Nov. 12, 1996, Pat. No. 5,706,735.

[51] Int. Cl.[7] ..... B61J 3/00; B61K 1/00

[52] U.S. Cl. ..... 104/88.03; 104/139; 104/140; 104/242; 105/33; 105/73

[58] Field of Search ..... 104/88.03, 88.04, 104/130.06, 139, 140, 142, 242, 243, 245, 246; 105/30, 33, 73

[56] References Cited

U.S. PATENT DOCUMENTS

| | | | |
|---|---|---|---|
| 3,628,462 | 12/1971 | Holt | 104/130.07 |
| 4,109,584 | 8/1978 | Mihirogi | 104/130.06 |
| 4,671,185 | 6/1987 | Anderson et al. | 104/130.07 |
| 5,706,735 | 1/1998 | Lund | 104/88.04 |

*Primary Examiner*—S. Joseph Morano
*Assistant Examiner*—Robert J. McCarry, Jr.

[57] ABSTRACT

A system is provided that uses small carrier vehicles that operate along electrified guideways and use standardized connections to automatically carry passenger cabins, freight loads and automobile platforms to desired destinations. Front and rear bogies of the vehicles pivot about front and rear vertical turn axes and carry direction control wheels that cooperate with guide ribs along tracks for selective control of movement to either of two exits from a Y junction. Electric power which can be three phase AC power can be supplied through upper and lower track structures. The upper track structures can define the guide ribs.

27 Claims, 18 Drawing Sheets

10
11
13
12
20
22
19

18
20A
20
19
19A
22
17
19B
20B 24
25B
26B
26A
25A
23

SYSTEM FOR AUTOMATED TRANSPORT OF AUTOMOBILE PLATFORMS PASSENGER CABINS AND OTHER LOADS

CROSS REFERENCE TO RELATED APPLICATIONS

Claim is made to the priority date of a prior copending national application in the USA of Van Metre Lund entitled "SYSTEM FOR AUTOMATED TRANSPORT OF AUTOMOBILE PLATFORMS, PASSENGER CABINS AND OTHER LOADS", U.S. Ser. No. 08/746,318, filed Nov. 12, 1996, this application being a continuation-in-part thereof. Said prior application U.S. Ser. No. 08/746,318, now U.S. Pat. No. 5,706,735 claims the priority of and is a continuation-in-part of the following national applications:

1) Application in the USA of Van Metre Lund entitled "INTEGRATED TRANSPORTATION SYSTEM INCLUDING TRANSFER VEHICLES", U.S. Ser. No. 08/475,750, filed Jun. 7, 1995, issued as U.S. Pat. No. 5,598,783 on Feb. 4, 1997;

2) Application in the USA of Van Metre Lund entitled "TRANSPORTATION SYSTEM INCLUDING ELEVATED GUIDEWAY", U.S. Ser. No. 08/477,182, filed Jun. 7, 1995, issued as U.S. Pat. No. 5,590,603 on Jan. 7, 1997; and 3) Application in the USA of Van Metre Lund entitled "TRANSPORTATION SYSTEM WITH HIGH SPEED VEHICLES AND AUTOMATIC CONTROL", U.S. Ser. No. 08/481,771, filed Jun. 7, 1995, issued as U.S. Pat. No. 5,590,604 on Jan. 7, 1997.

Said prior application U.S. Ser. No. 08/746,318 also claims the priority of and is a continuation-in-part of an International Application under the Patent Cooperation Treaty, that names AUTRAN CORP. for all designated states except US and that names Van Metre Lund for the US, International application No. PCT/US96/09390, International filing date Jun. 6, 1996. A request to begin national examination procedures in the United States was filed on Dec. 1, 1997.

The disclosures of said prior applications are incorporated herein by reference.

BACKGROUND OF THE INVENTION

1. Field of the Invention

This invention relates to a transportation system and more particularly to a system usable for transportation of people as well as automobiles and other freight loads with very high safety, efficiency, speed and convenience, with capital costs and fuel, labor and other operating costs being minimized and with minimal adverse environmental effects. The system is compatible with existing systems and is readily integrated therewith.

2. Background of the Prior Art

Conventional rail systems have become increasingly costly to construct, maintain and operate with the result that their use for transport of freight and for interurban passenger travel has been supplanted to a large degree by use of trucks and automobiles. For public transportation in cities, rail-supported street cars have been replaced by buses which have been used less and less as a result of the increased use of automobiles for personal travel. The resulting truck and automobile traffic over streets and highways is a problem of increasing magnitude.

Systems known as "Intelligent Vehicle Highway Systems" are now being proposed for reducing certain problems associated with automobiles and are receiving considerable attention, but it appears that they may be very expensive and the degree to which such systems will be successful is open to question. Systems have been also been used or proposed using automatically operated and driver-less vehicles supported on elevated "monorail" guideways, but such systems have generally been limited to use on a small scale in special applications and have not enjoyed widespread success.

SUMMARY OF THE INVENTION

This invention was evolved with the general object of overcoming disadvantages of prior transportation systems and of providing a practical system for general use in transportation of people and freight in urban and interurban use.

Another object of the invention is to provide a transportation system which is compatible with existing transportation systems.

A further object of the invention is to provide a transportation system which makes practical use of existing technology and which is so constructed as to allow for expansion and for the use of improvements which may reasonably be expected in the future from advancing technology.

Important features of the invention relate to the support of a carrier vehicle on lower tracks of a guideway that has upper tracks performing the functions of limiting upward and tilting movements of the vehicle and supplying electrical power thereto.

A specific feature relates to the use of upper tracks in guiding the path of movement of movement of a vehicle. Front and rear pairs of upper wheels are provided that so interengage the upper tracks as to limit relative movement in a transverse direction. In one embodiment, such upper wheels are wheels formed with annular peripheral grooves to receive the upper tracks.

Another feature relates to the control of pressure between upper wheels and upper tracks and the lowering of upper wheels on either side of the vehicle to control movement through Y junctions.

A further feature is in the journaling of wheels on front and rear bogies each of which can turn about a vertical turn axis and in the control of turn angles of such bogies when moving on guideway that is curved, operating to move horizontal axes of the wheels of the bogie toward alignment with center of the curve of the guideway. A specific feature is in the provision of auxiliary wheels that interengage guide ribs that may be formed by upper tracks and the wheels being on a transversely movable carriage connected to the bogies and located between the turn axes of the bogies.

Additional important features relate to a drive train for drive of a vehicle from an induction motor connected to a fixed frequency AC supply and thereby limited to operation in a narrow speed range. The drive train includes a variable speed control motor which is preferably reversible and which is preferably operable as a generator as well as a motor. The control motor is combined with a power divider unit and a multi-speed transmission in a manner such as to obtain very efficient operation coupled with very good performance and high reliability.

Further specific features of the invention relate to the use of a three phase motor and in the use of upper and lower tracks in directly connecting the motor to three phase supply lines.

This invention contemplates many other objects, features and advantages which will become more fully apparent from the following detailed description taken in conjunction with the accompanying drawings.

DESCRIPTION OF PREFERRED EMBODIMENTS

Figures 1, 2, 3:
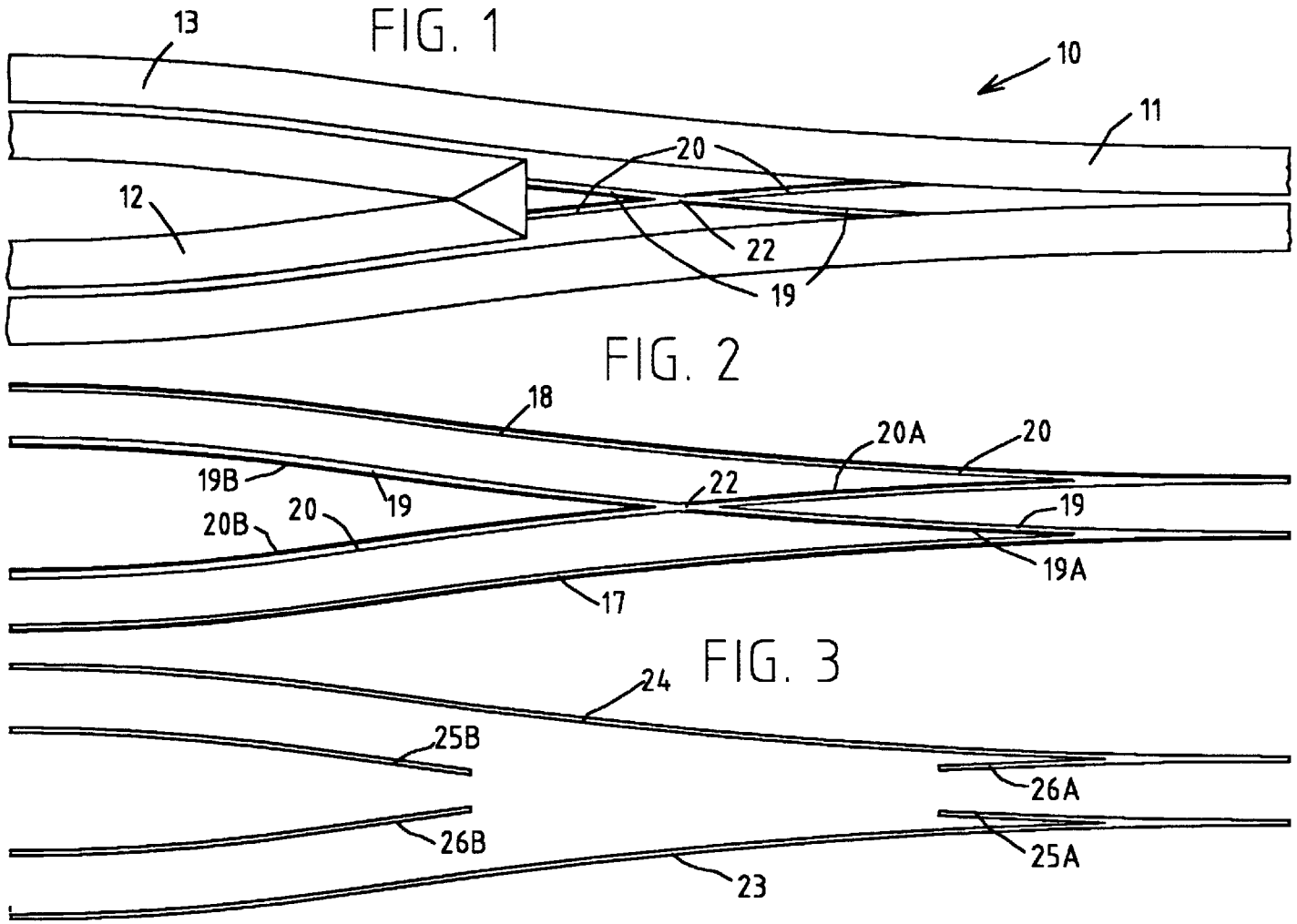
FIGS. 1, 2 and 3 illustrate the construction and operation of a Y junction of a guideway.

FIG. 1 is a top plan view of a Y guideway junction 10 of a transportation system constructed in accordance with the principles of this invention. The junction 10 interconnects a guideway extending to the right from an entrance end 11 and two guideways extending to the left from exit ends 12 and 13. Carrier vehicles are supported by pairs of lower and upper track structures within the guideways and are assumed to travel to the left as viewed in FIG. 1.

For support of automobile platforms, passenger cabins or other loads, the carrier vehicles have support posts that extend upwardly through narrow slots such as indicated by reference numerals 14, 15 and 16, formed by upper wall portions of the guideways and of adjacent portions of the Y junction 10.

FIG. 2 shows the layout of lower track structures within the Y junction 10. Track structures 17 and 18 form left and right track structures at the entrance end 11 and at the exit ends 12 and 13. Track structures 19 and 20 extend from the track structures 17 and 18 near the entrance end 11 and cross at a crossover junction 22 to form left and right track structures at the exit ends 13 and 12.

Guide means are provided for coaction with control means of carrier vehicles to select either the exit end 12 or the exit end 13. In the illustrated junction 10, guide ribs 17A and 18A extend upwardly from the outer sides of the lower track structures 17 and 18 and extend continuously along the length thereof. To move to the exit end 12, position and control wheels on the right side of a vehicle may be elevated while those on the left side are lowered to engage the rib 17A. To move to the exit end 13, position and control wheels on the left side of a vehicle may be elevated while those on the right side are lowered to engage the rib 18A. Additional guide ribs 19A, 20A, 19B and 20B are provided along portions of the track structures 17 and 18 to limit transverse movement of traction wheels of vehicles and provide additional insurance that the vehicles will follow the desired paths.

FIG. 3 illustrates the configuration of upper track structures of the junction 10. Track structures 23 and 24 correspond to lower track structures 17 and 18. Track structures 25A and 25B correspond to right and left portions of the track 19 while track structures 26A and 26B correspond to right and left portions of the track 20, gaps in the upper track structures being provided to avoid interferences when vehicles move through the junction 10. When a vehicle moves to the left from the entrance end 11, the left upper wheels thereof initially engage the track 25A, then move out of contact with any track and then engage track 25B. Similarly, when a vehicle moves to the right from the entrance end 11, the right upper wheels thereof initially engage the track 26A, then move out of contact with any track and then engage track 26B.

The track structures 25A and 26A are sloped upwardly from right ends near the entrance end to elevated left ends, the result being that the upper wheels engaged thereby are gradually allowed to be moved upwardly by traction control springs of bogies of vehicles until reaching an upper limit position. Similarly, the track structures 25B and 26B are gradually sloped downwardly from elevated right ends to left ends that are at the proper level for normal forces of engagement by upper traction wheels of vehicles.

FIGS. 4–21 relate to features of construction of a guideway section and an associated carrier vehicle. Track structures are provided that are of laminated form and that have other features which operate to minimize thermal expansion problems and to produce a very smooth path for travel of carrier vehicles. The track structures are also so constructed and mounted as to facilitate installation and servicing. In addition they include insulated supports such that electrical current is supplied through the track structures and through wheels of the carrier vehicle and through associated slip ring assemblies thereof, eliminating the need for separate electrical supply rails and also achieving a high degree of reliability. The carrier vehicle also includes an advantageous turn control assembly.

Figure 4:
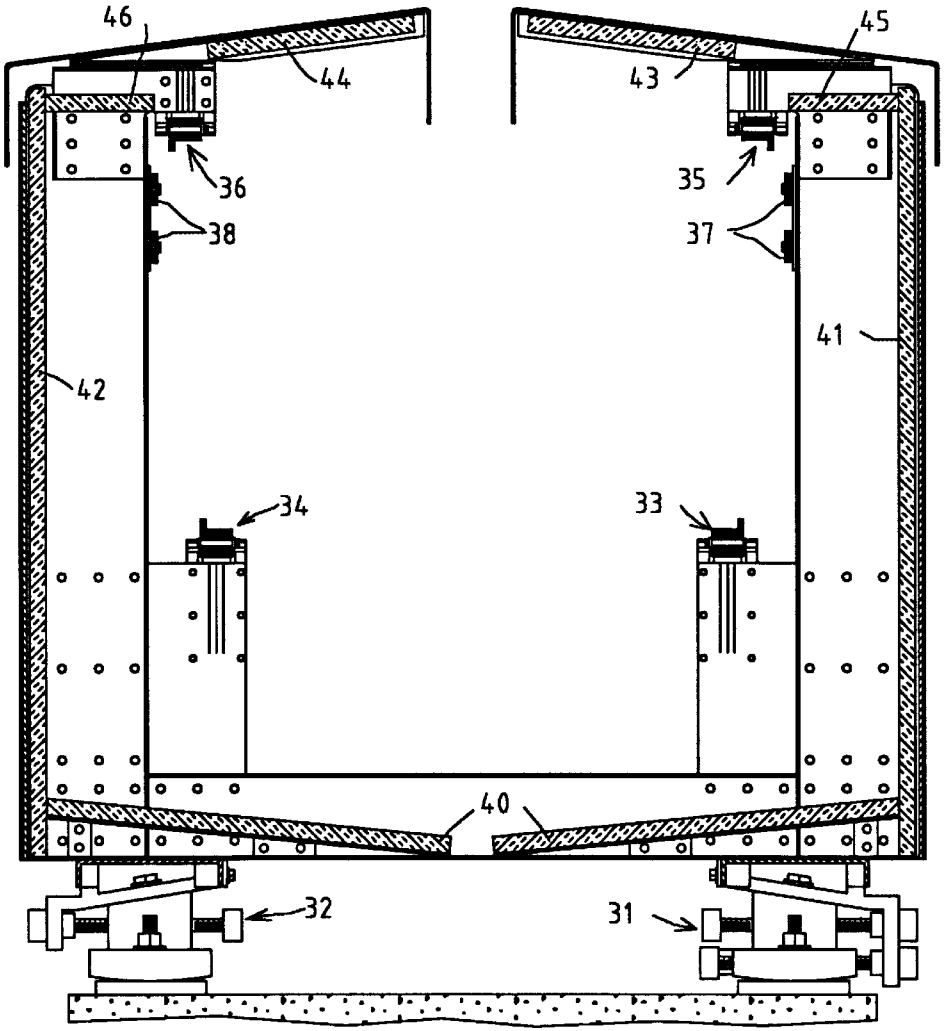
FIG. 4 is a sectional view of a guideway section of the invention.

FIG. 4 is a cross-sectional view of a guideway section 28. One end thereof and one end of an adjacent section are supported from a support column 30 by left and right adjustable mechanisms 31 and 32, it being noted that FIG. 4 is a view looking rearwardly and is described with reference to a forward direction of travel so that elements that appear on the right side of the drawing are referred to as left elements, and vice versa.

Left and right lower track structures 33 and 34 and left and right upper track structures 35 and 36 are provided that may be connected to and extend rearwardly from the right ends of the structures 19, 20, 23 and 24 of the junction 10 as shown in FIGS. 1–3. Each of the structures 33–36 includes support elements that provide resilient support and that may be of electrically insulating material to permit supply of electrical power through the track structures and through the wheels of carrier vehicles to drive motors and other components thereof. The lower track structures 33 and 34 are connected to one terminal of an electrical power source while the upper track structures 35 and 36 are connected to an opposite terminal of the source. Also, as will be described in connection with FIGS. 10–18, each of the structures 33–36 has a laminated construction and other features that operate to obtain a number of important advantages.

The guideway section 28 includes left and right pairs of transmission line assemblies 37 and 38 which are mounted alongside the path of travel of carrier vehicles to be inductively coupled to devices carried by the carrier vehicles. It also includes structures that are in longitudinally spaced relation for support of the track structures 33–36 and sheets 40–44 of an acoustic energy absorbing material on the inside of bottom, side and top walls thereof to minimize the transmission of noise to regions on the outside thereof.

Figure 5:
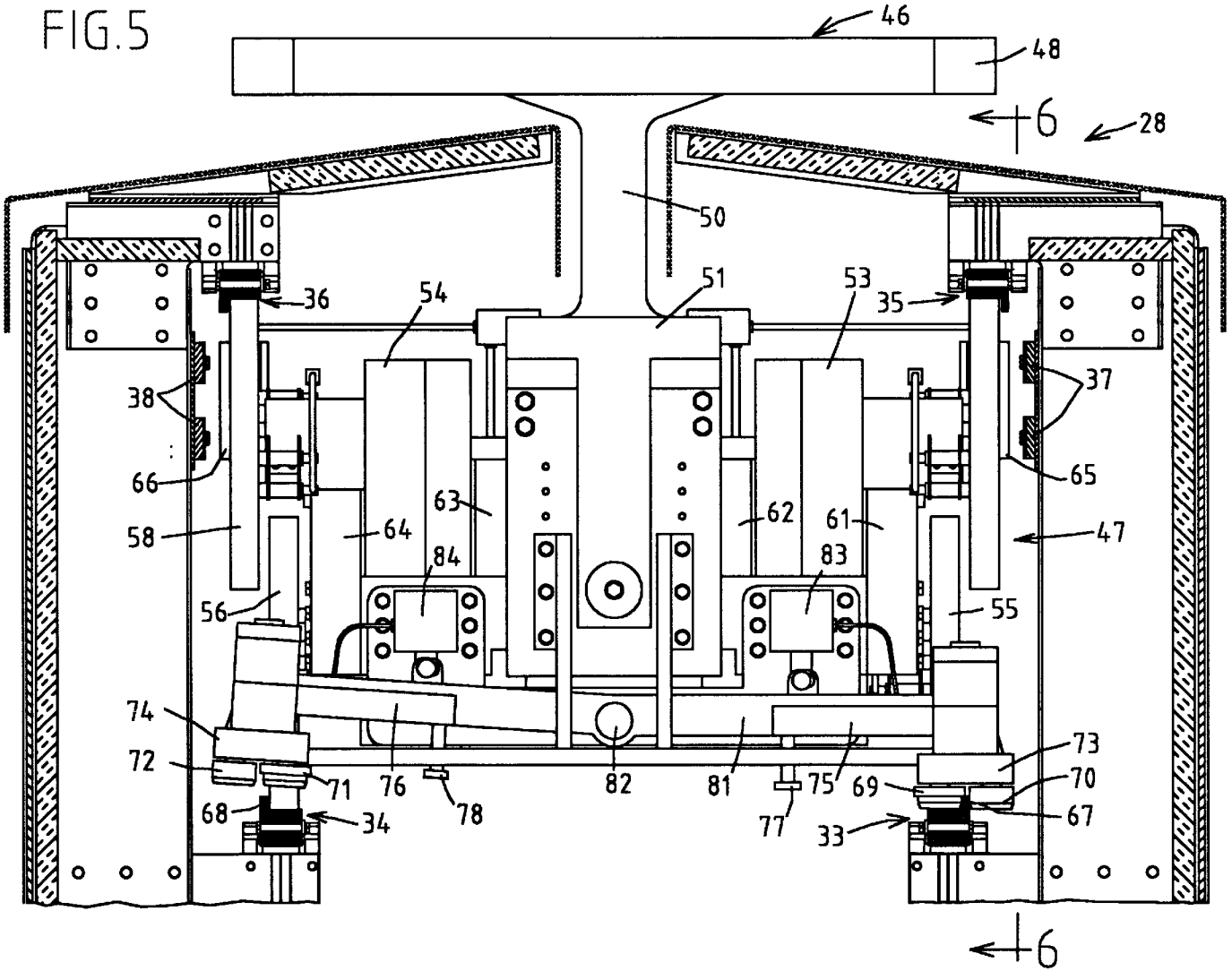
FIG. 5 is a sectional view similar to FIG. 4 and providing a front elevational view of a carrier vehicle with a front fairing structure thereof removed.

FIG. 5 is a sectional view similar an upper portion of FIG. 4 and providing a front elevational view of a front bogie 47 of carrier vehicle 46 with a front fairing structure thereof removed. For support of an automobile platform, passenger cabin or other load, a standardized connection 48 is provided on the upper end of a front post 50 that is carried by a frame 51 of the vehicle and that is in approximate alignment with a vertical turn axis of the front bogie 47. Bogie 47 includes left and right bearing units 53 and 54 that journal left and right lower traction wheels 55 and 56 and left and right upper traction wheels 57 and 58. The bearing units 53 and 54 are pivotal relative to the bogie 47 about a horizontal axis midway between the axes of the lower and upper traction wheels and, through springs acting thereon, forces are applied to urge the upper traction wheels 57 and 58 into engagement with the upper track structures 35 and 36 while applying forces aiding gravitational forces in urging the lower traction wheels into engagement with the lower tracks. The bogie 47 includes four transversely spaced frame members 61, 62, 63 and 64, the left bearing unit 53 being supported between frame members 61 and 62 while the right gear unit 54 is supported between frame members 63 and 64. Left and right inductive coupling units 65 and 66 are provided for cooperation with the transmission line assemblies 37 and 38.

Left and right guide ribs 67 and 68 project upwardly from outer sides of the lower track structures 33 and 34. To make the vehicle 46 go to the left through a junction such as junction 10, a left pair of inner and outer turn control wheels 69 and 70 are in a lowered active position to embrace the left guide rib 67 while a corresponding right pair of inner and outer turn control wheels 71 and 72 are in an elevated inactive position as shown. To make the vehicle 46 go to the right, the wheels 71 are lowered to embrace the right guide rib 68 while the wheels 69 and 70 are in an upward inactive position.

The left turn control wheels 69 and 70 and the right turn control wheels 71 and 72 are journaled by left and right support members 73 and 74 that carry inwardly extending arms 75 and 76 which support cam follower elements in the form of pins 77 and 78 extending downwardly and through slots in a cam plate 80 supported from the frame 51 of the vehicle. Rearward end portions of the support members 73 and 74 are pivotally supported at opposite ends of a turn control member 81 that is carried by a shaft 82 and that is controlled by a pair of solenoids 83 and 84 to control movements of the left and right turn control wheels 69, 70 and 71, 72 between active and inactive positions.

Figure 6:
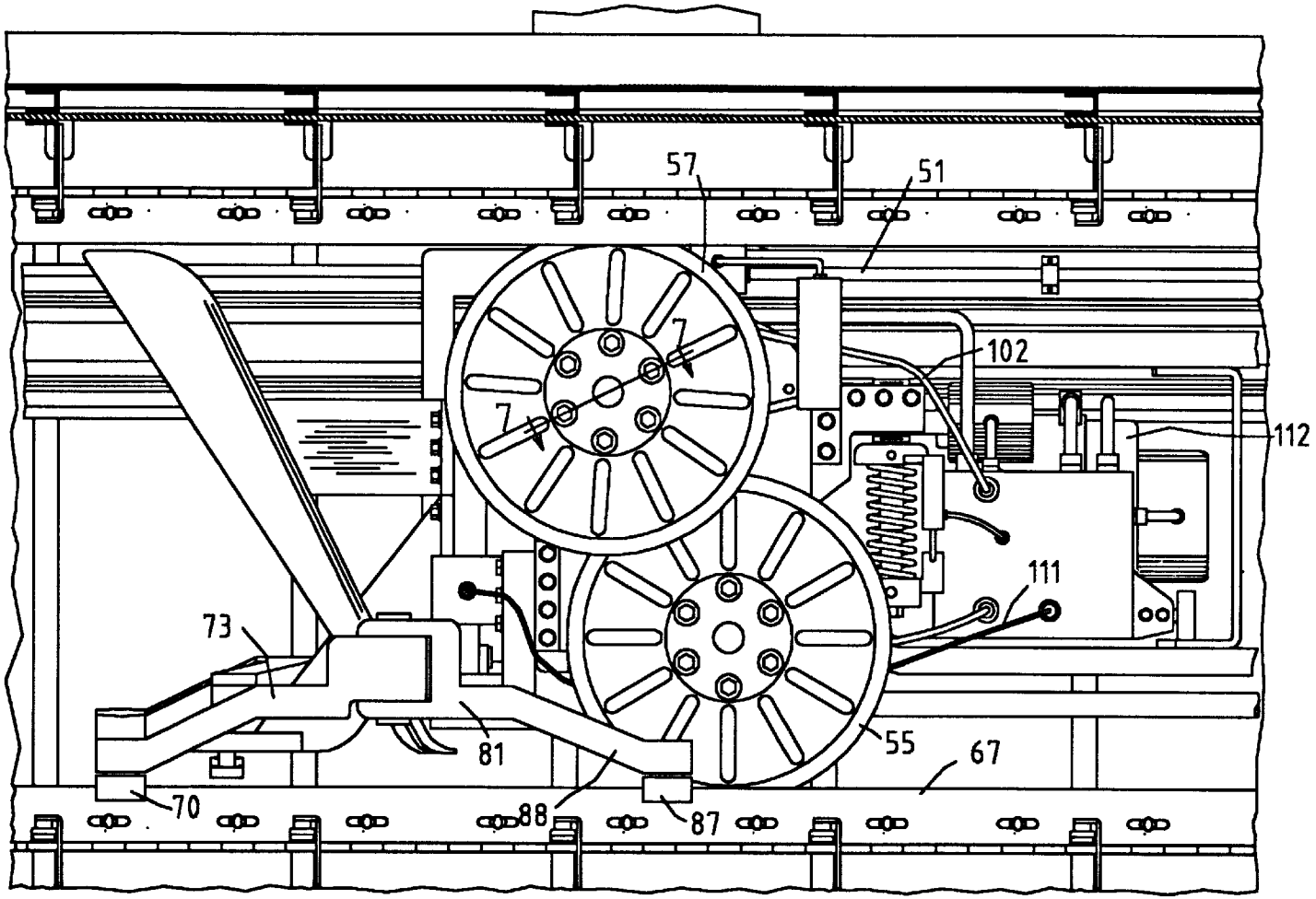
FIG. 6 is a sectional view taken substantially along line 6—6 of FIG. 5, providing a side elevational view of a front bogie of the carrier vehicle shown in FIG. 5 but with the front fairing structure mounted thereon.

FIG. 6 is a sectional view taken substantially along line 6—6 of FIG. 5, providing a side elevational view of the front bogie 47 of the carrier vehicle 46 shown in FIG. 5 but showing a front fairing structure 86 that is supported from the vehicle frame 51. A left side position control wheel 87 is journaled for rotation about a vertical axis at the rearward end of a part 88 which extends rearwardly from the left end of the position control member 81. A similar construction is provided at the right side of the bogie 47 and includes a right side position control wheel, not shown. When the turn control member 81 is positioned as shown, for travel of the vehicle 46 to the left through a Y junction, the left side position control wheel 87 is on the outside of the left guide rib 67 and operates to limit movement of the bogie 47 to the right. A similar function is performed by the right side position control wheel that is not shown. Further details of the turn control structure and its operation are described hereinafter in connection with FIGS. 19 and 21.

Each of the traction wheels 55–58 of the front bogie has a construction such as to include a metallic outer peripheral rim portion that is electrically insulated from but securely supported by a support shaft and that is electrically connected through a slip ring assembly to motor and control circuitry of the vehicle 46. Outer rim portions 55A and 57A of the left wheels 55 and 57 engage the lower and upper left track structures 33 and 35 and are supported at the periphery of web portions 55B and 57B which are of reduced thickness but which have radially extending and angularly spaced rib formations for strength and rigidity.

Figures 7, 8:
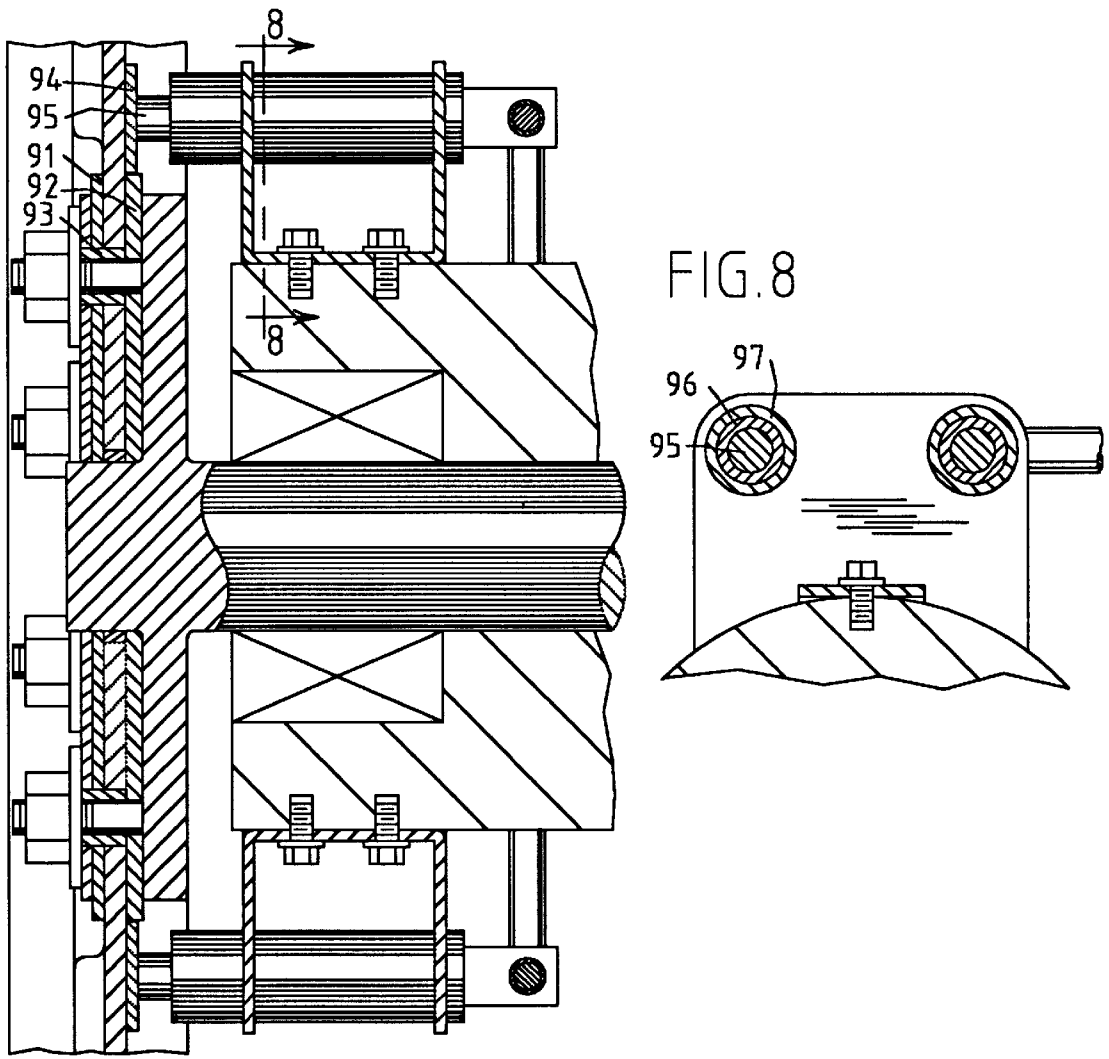
FIG. 7 is a sectional view taken substantially along line 7—7 of FIG. 6, showing the construction of an upper wheel of the illustrated bogie and showing a slip ring assembly for conduction of electrical current from electrified tracks of the guideway and through the wheel to circuitry of the carrier vehicle.
FIG. 8 is a sectional view taken substantially along line 8—8 of FIG. 7, showing the mounting of brushes of the slip ring assembly of FIG. 7.

As shown in the sectional view of FIG. 7, an inner part of the web portion 55B of the upper left wheel 55 is clamped between a clamp plate 89 and a hub 90 by means of nuts that are threaded on stud bolts projecting from the hub 90, members 91, 92 and 93 of electrically insulating material being provided between web portion 55B and the clamp plate 89, hub 90 and stud bolts. Hub 90 is on a shaft 94 which is journaled by a bearing 95 within a portion 96 of the bearing unit 53.

A slip ring 98 of conductive material is secured to the inner side of the web portion 55B and is engaged by two pairs of brushes 99 each being mounted within an insulating sleeve 100 that is disposed within a mounting sleeve 101 and each being engaged by a spring to be urged against the slip ring 94.

Figure 9:
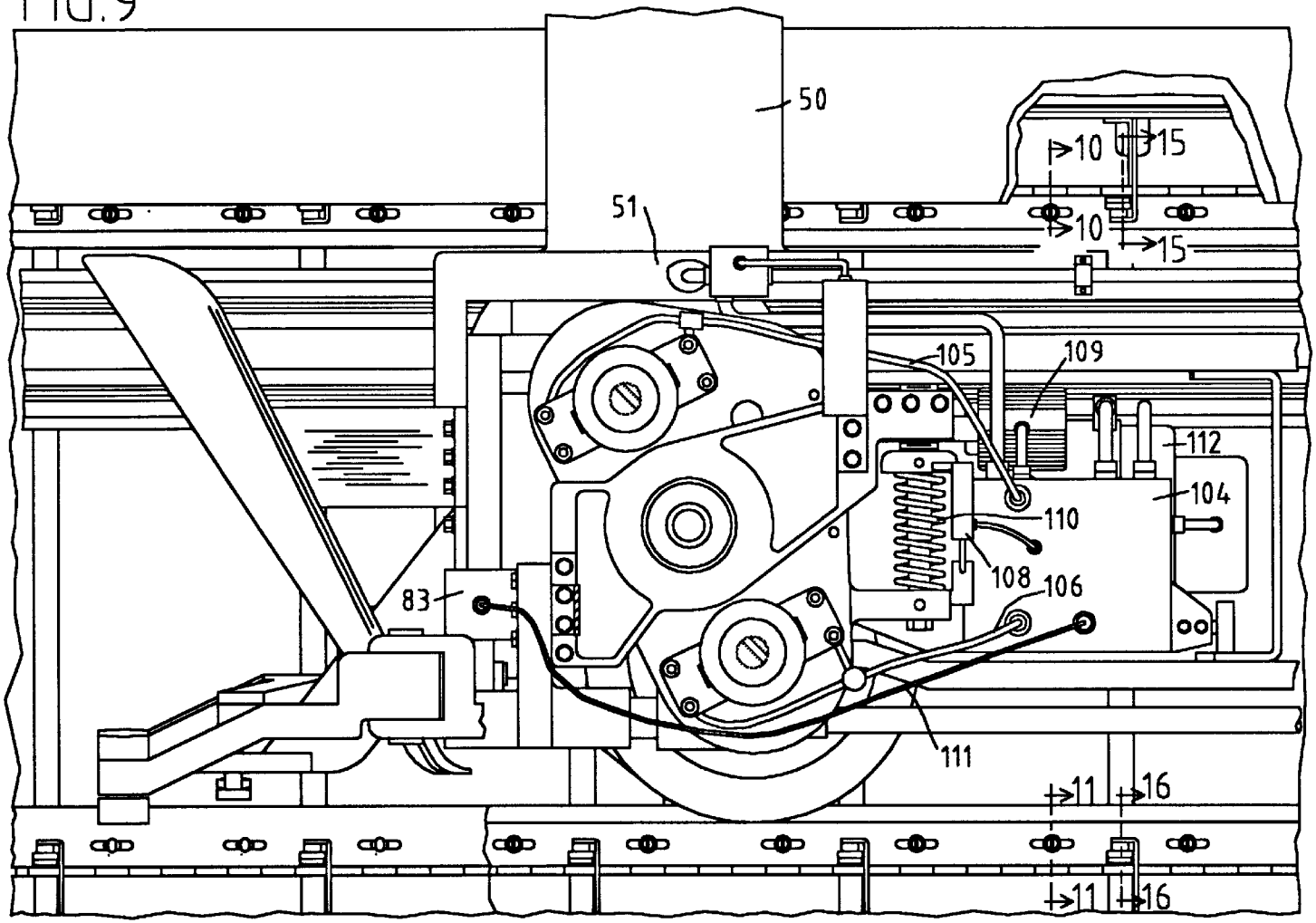
FIG. 9 is a sectional view like FIG. 6 but with wheels and other parts removed.

FIG. 9 is a view similar to FIG. 6 but with the left wheels 55 and 57 of the front bogie removed. As shown, a control unit 104 is connected through a cable 105 to terminal posts for all four of the brushes 99 of the upper wheel slip ring assembly and through a cable 106 to corresponding brushes of the lower wheel slip ring assembly.

Control unit 106 is also connected through a cable 107 to a position sensing device 108 usable in weight measurements and in controlling traction forces as a function thereof. A left traction control motor 109 operates through a lead screw assembly to control the force applied by a spring 110 and to thereby control a torque applied about an axis midway between the axes of the lower and upper left traction wheels 55 and 7 and to thereby control the traction forces between such wheels and the lower and upper track structures 33 and 35. In weight measurements, traction control motor 109 is usable in conjunction with the position sensing device 108 and in conjunction with monitoring of the current that flows from the upper track structure and through the left upper wheel to a test load. To measure the weight carried by the left side of the front bogie, the force applied by the spring 100 is gradually reduced and weight-indicating data from position sensing device 108 is registered when contact is broken and the current abruptly falls to zero. Initially or at periodic maintenance times, a calibration procedure is used to determine the relationship between registered position data and one or more weights of known magnitude. At any time when the vehicle is then connected to a load of unknown weight, accurate data can be obtained for use in control of traction in accordance with the weight of the vehicle and its load.

FIG. 9 shows a cable 111 connecting the solenoid 83 to the control unit 104. It also shows portions of an electric drive motor 112 of the front bogie which is coupled to all four traction wheels 55–58 through a gearing arrangement that allows a differential in velocity between wheels on opposite sides of the vehicle when going around turns.

Figures 10, 11, 12, 13:
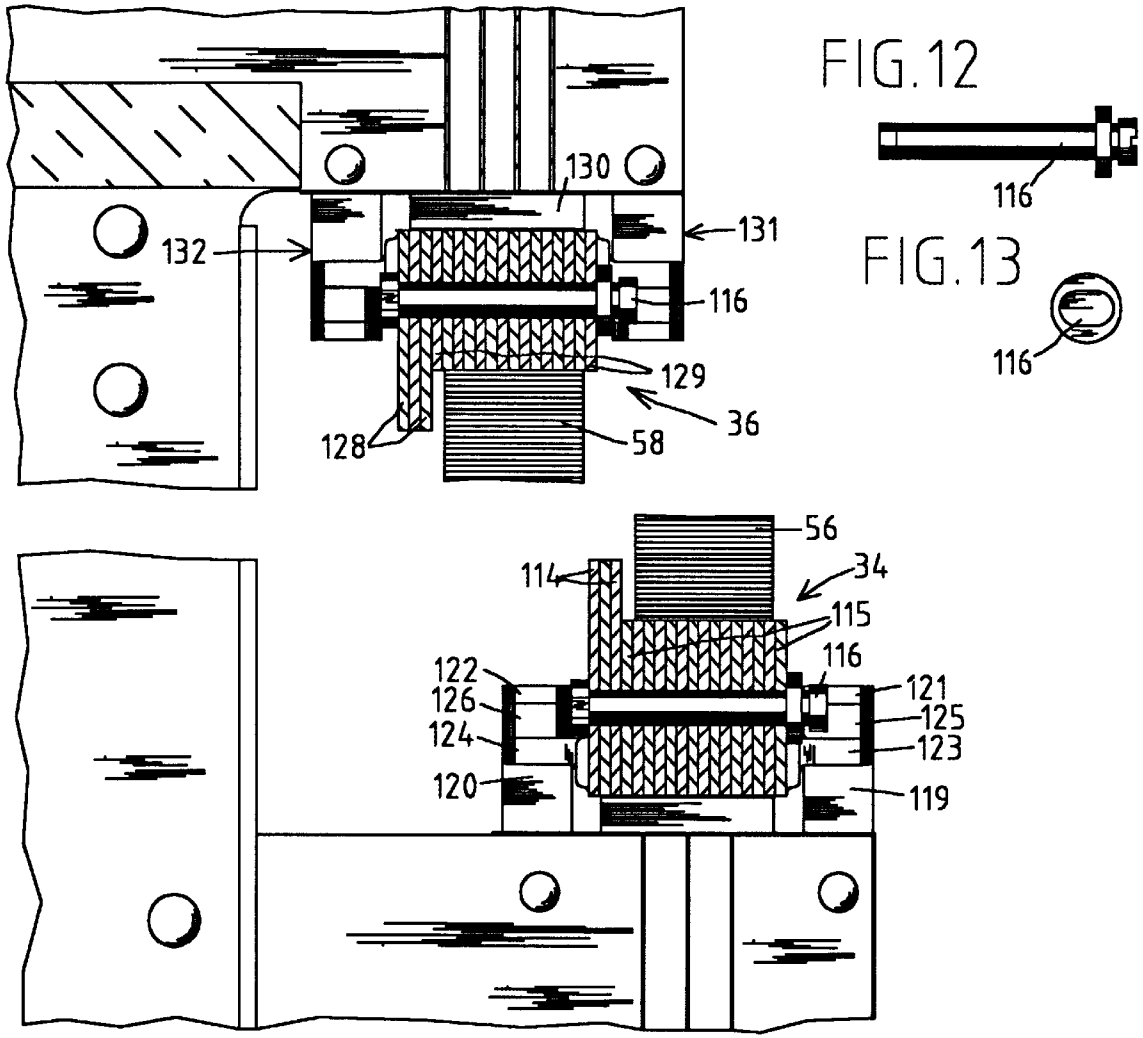
FIG. 10 is a sectional view taken substantially along line 10—10 of FIG. 9.
FIG. 11 is a sectional view taken substantially along line 11—11 of FIG. 9.
FIGS. 12 and 13 are side and end elevational views of a connecting element usable in the track structures of FIGS. 10 and 11.
Figure 14:
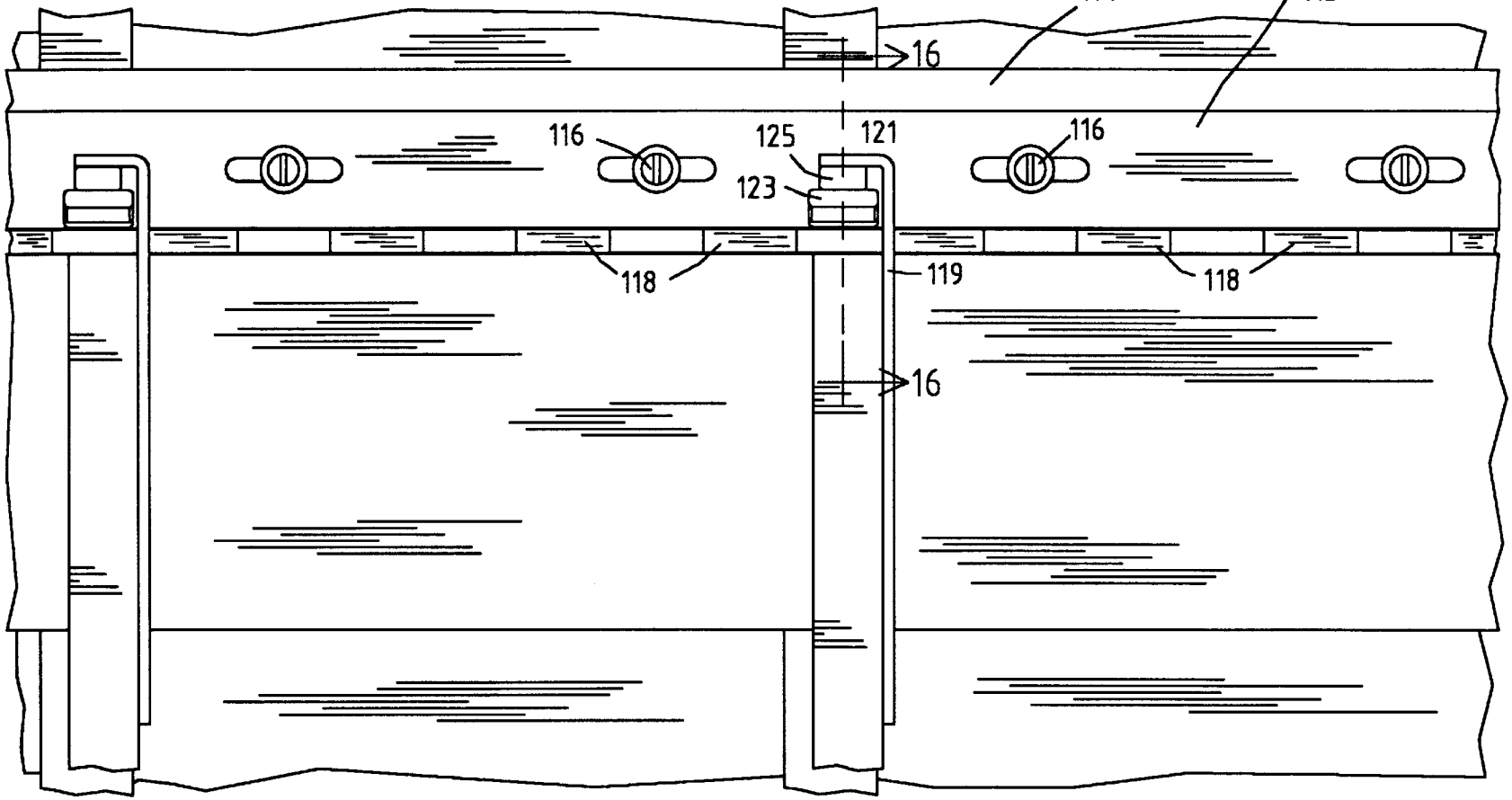
FIG. 14 is a side elevational view of a portion of the lower track structure, corresponding to a portion of FIG. 9 but on approximately the same enlarged scale as that of FIGS. 10 and 11.

In FIG. 9, portions of the left track structure are broken away to show portions of the lower and upper right track structures 34 and 36, features of construction of which are shown in the sectional views of FIGS. 10, 11, 15 and 16, in the detail views of FIGS. 12 and 13 and in FIG. 14 which is an enlargement of a portion of FIG. 9.

Figure 16:
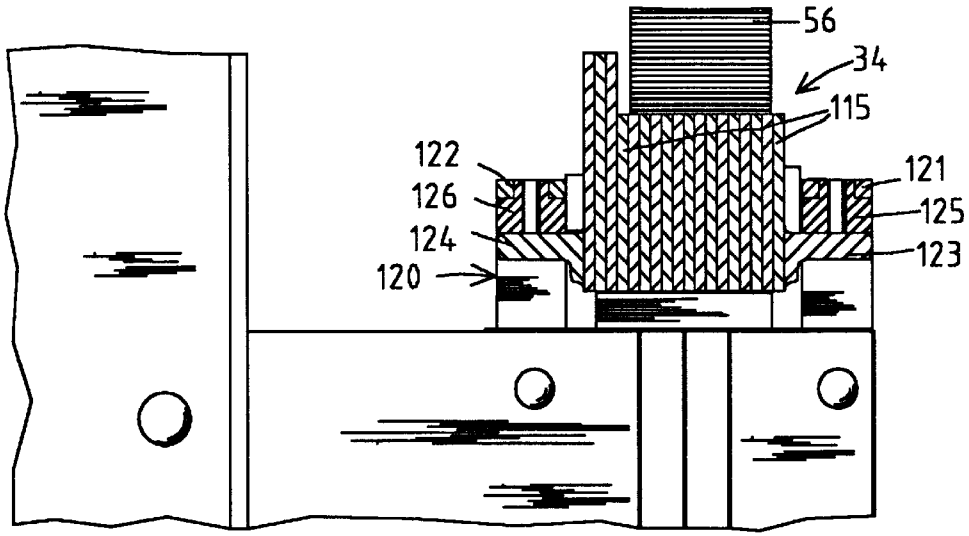
FIG. 16 is a sectional view of the lower track structure taken substantially along line 16—16 of FIG. 9, also line 16—16 of FIG. 14.

The lower track structure 34 as shown in FIGS. 11 and 16 includes a laminated assembly formed by elongated strips, each of which has a width in a vertical direction that is substantially greater than its thickness in a transverse horizontal direction. As shown, three strips 114 form the guide rib 68 on the outer side of the right track structure 34 and fifteen strips 115 form a main wheel engaging portion of the structure 34.1 Connecting pins 116 extend through elongated and longitudinally spaced slots 117 in the strips to hold them together as an assembly which is supported by longitudinally spaced blocks 118 of rubber or an equivalent elastomeric and electrically insulating material.

The strip assembly is tied to each of a series of longitudinally spaced track support members by a pair of inner and outer tie elements 119 and 120 which have holding portions 121 and 122 in overlying relation to connect elements 123 and 124 that are welded or otherwise secured to the inside and outside of the innermost and outermost strips of the assembly. Elements 125 and 126 of a resilient and electrically insulating material are disposed between holding portions 121 and 122 and connect elements 123 and 124 and on upstanding pin portions of the connect elements, in a manner such as to allow limited upward movement while preventing any substantial sidewise movement of the track structure.

Figure 15:
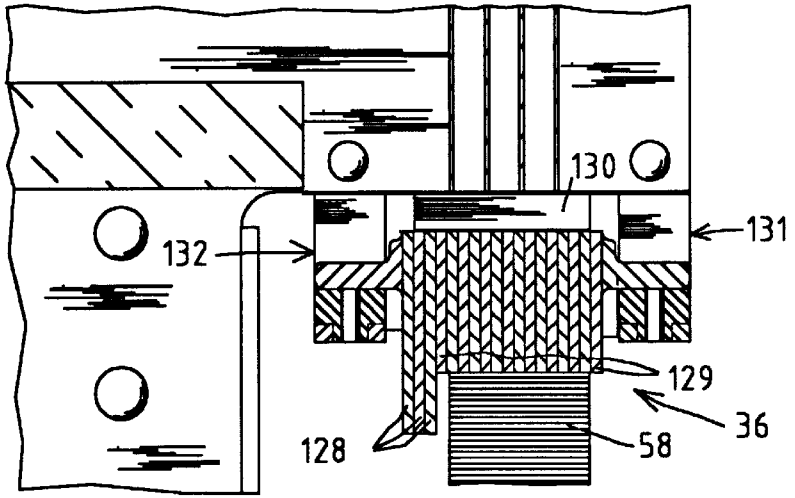
FIG. 15 is a sectional view of the upper track structure taken substantially along line 15—15 of FIG. 9.

As shown in FIGS. 10 and 15, the construction of the upper right track structure 36 has a form in inverted relation to the lower track structure but is otherwise very similar. It includes strips 128 and 129 that correspond to strips 114 and 115, but with smaller vertical dimensions, and that are secured together by the same connecting pins 116 to form an assembly that is supported against upward movement by longitudinally spaced blocks 130 which correspond to blocks 118 of the lower track structure 34. Track structure 36 also includes tie elements 131 and 132 that correspond to tie elements 119 and 120 and that have holding portions 133 and 134 underlying relation to connect elements 135 and 136 with elements 137 and 138 of a resilient and electrically insulating material are disposed between holding portions 133 and 134 and connect elements 135 and 136 and on upstanding pin portions of the connect elements, in a manner such as to allow limited downward movement while preventing any substantial sidewise movement of the track structure 36.

The construction of the connecting pins 116 is shown in FIGS. 12 and 13 and is such that they can be inserted through slots in the strips and then rotated ninety degrees to lock the strips together.

Figure 17:
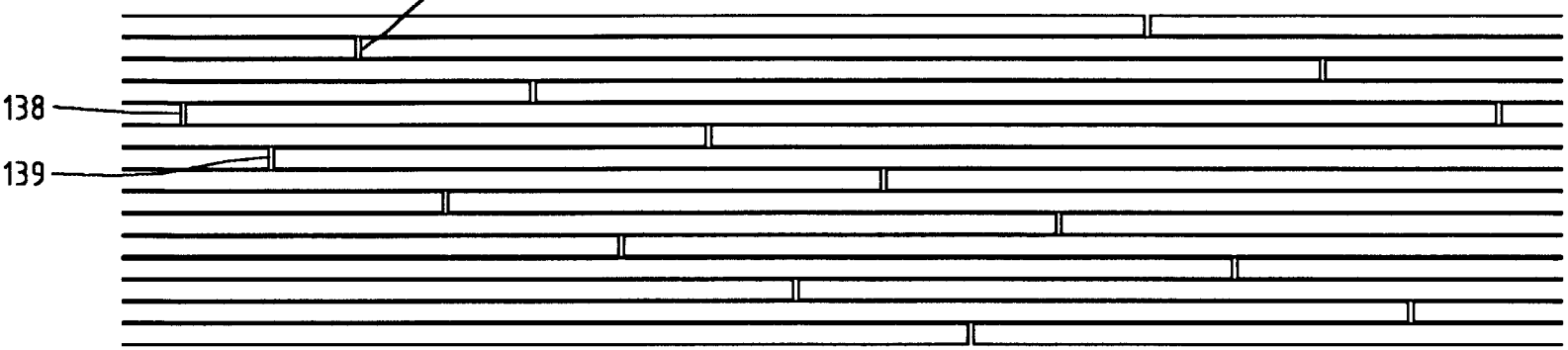
FIG. 17 depicts an illustrative pattern of offsets of strips forming a track.

FIG. 17 depicts an illustrative pattern of offsets of strips forming a main wheel engaging portion of a strip assembly of a track structure. In assembly of the strips, a small spacing is provided in each junction region between each end of each strip and the end of a strip in longitudinal alignment therewith, to allow for thermal expansion. Such junctions are spaced longitudinally and in a pattern such as to provide a substantially uniform support for vehicle wheels.

For clarification, the widths of the strips as shown is greatly enlarged in relation to the longitudinal direction. By way of example, each of the illustrated fifteen strips of the lower track structure 34 may be assumed to have a width of approximately 0.158 inches and a length of 240 inches, with there being a longitudinal spacing of 16 inches between each junction region and the next junction region. Thus there may be longitudinal distance of 16 inches between a junction 138 and a junction 139, a longitudinal distance of 16 inches between the junction 139 and a next junction 140, and so on.

Figure 18:
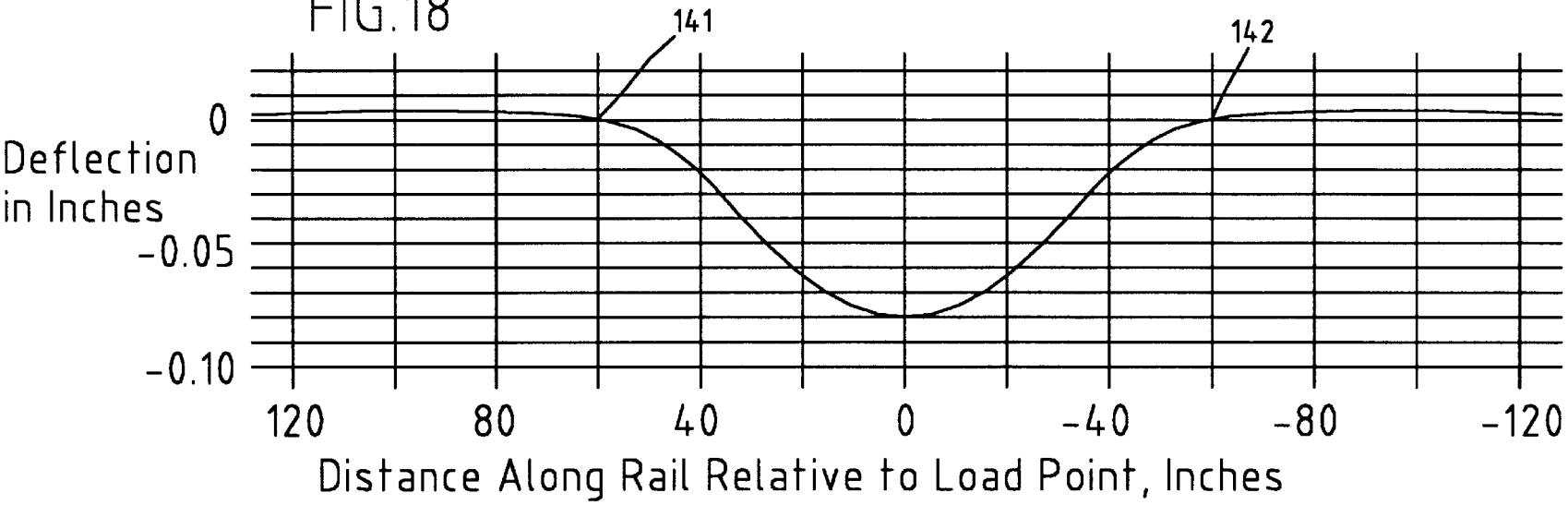
FIG. 18 is a graph illustrating the deflection under load of a track structure along its length.

The construction of the track structures takes into account an analysis of deflection of tracks under load, as set forth at pages 244–252 of a text "RAILROAD ENGINEERING" by William W. Hay, Second Edition, published by John Wiley & Sons. FIG. 18 is a graph that is based upon such analysis and that shows the deflection of a rail structure under load. This graph assumes a solid continuous steel rail having a modulus of elasticity of 30,000,000 psi and having a width of 2.375 inches and a thickness of 2.5 inches, carrying a load of 3750 pounds and on a track support having a modulus of elasticity or track stiffness modulus of 933 pounds per inch of deflection per inch of rail.

The maximum deflection is computed to be 0.08 inches and the distances along the track from the load point to points of reverse flexure, indicated by reference numerals 141 and 142, is computed to be 59.16 inches.

With a laminated track structure as disclosed, most of the strips are loaded in a central portion thereof at any given time to restrict deflection to substantially the same degree as would be the case with a continuous strip. In addition, with the strips tied together by the tie pins 116, the deflection of each strip is always inhibited by the other strips and a support is obtained which is nearly uniform and which approaches that of a continuous track structure.

It is noted that each pin 116 preferably has an oval or elliptical cross-sectional shape with dimensions such as to facilitate insertion through the slots of the strips and while being then rotatable ninety degrees into tight pressure engagement with the lower and upper surfaces of the slots. Such tight pressure engagement is highly desirable to keep the pins in locked positions and also to so lock the strips together that they deflect together when a wheel load is applied thereto, each strip being locked to the other strips through the pins to limit independent deflection of the strips and to produce deflections approximating those obtained with a solid continuous track structure.

By way of example, each strip may have a thickness of 0.15833 inches, producing a total width of 2.375 inches and the width of each wheel engaging strip 115 of the lower track structures may be 2.5 inches so that the wheel engaging portion may be assumed to be equivalent to a solid track having a width of 2.375 inches and a thickness of 2.5 inches. The strips 114 may have a vertical dimension of 3.5 inches to provide a guide rib that is 1 inch high. The strips of the upper trick structure 36 may have the same dimensions as those of lower track structure, differing only in that the vertical dimensions of the corresponding strips are reduced by 1 inch.

The deflection of a guideway section under load may not be a serious problem but the track structures may preferably be so constructed as take deflection into account and obtain a substantially uniform downward deflection vehicles moving on the guideway, regardless of the loading thereto. Preferably, the dimensions and durometers of the rubber blocks are so selected and the spacings thereof along the section are so varied as to produce required downward and upward deflections of the lower and upper tracks along each guideway section.

Figure 19:
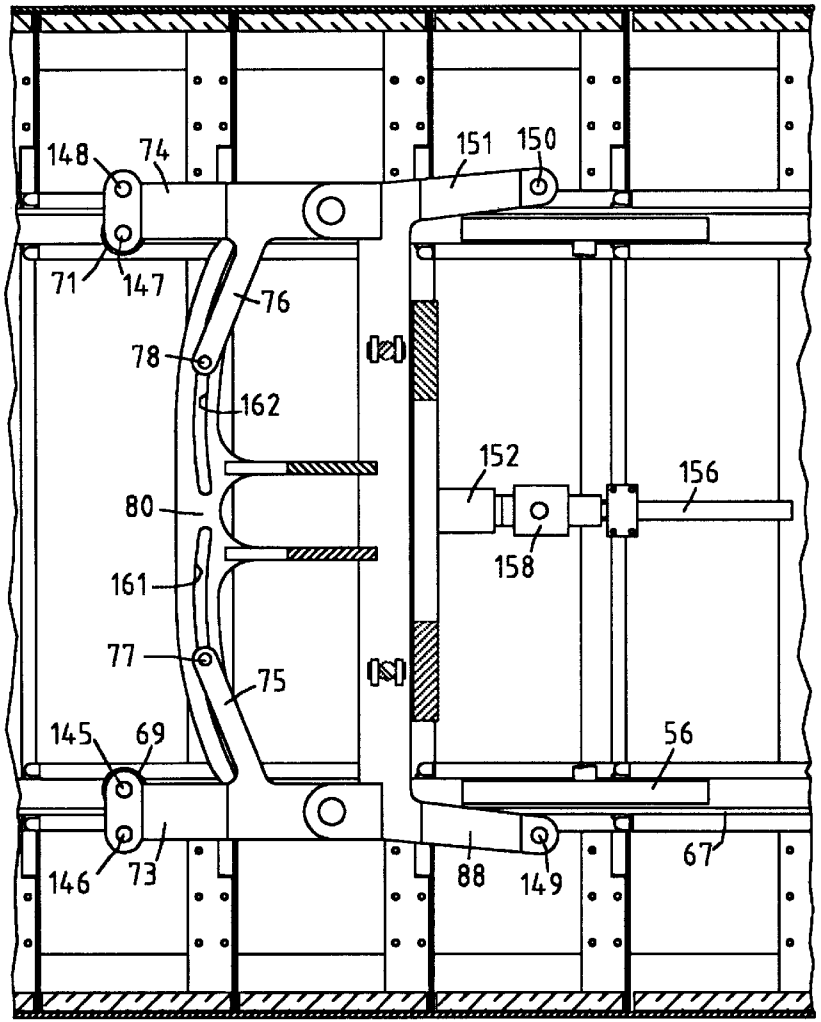
FIG. 19 is a sectional view looking downwardly at a turn control assembly of the carrier vehicle shown in FIGS. 5 and 6.
Figure 20:
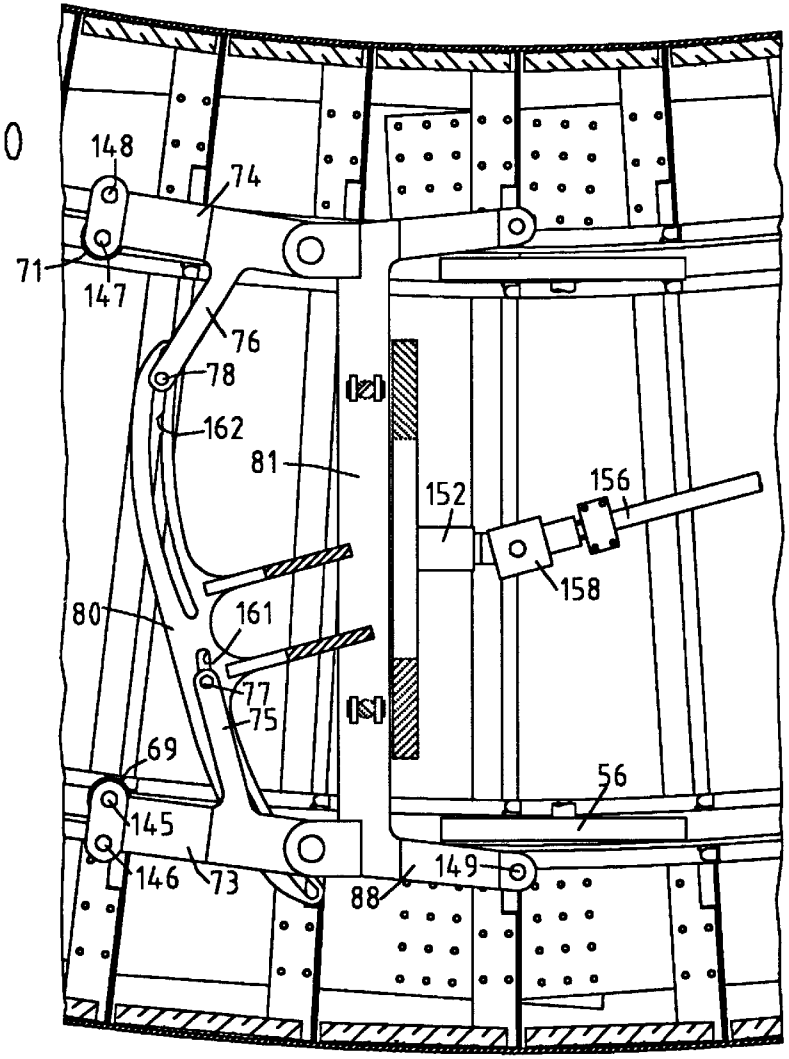
FIG. 20 is a view like FIG. 19 but showing the condition of the assembly when the carrier vehicle is moving on a short radius guideway turn.

FIG. 19 is a sectional view looking downwardly at a turn control assembly of the carrier vehicle shown in FIGS. 5 and 6 and FIG. 20 is a view like FIG. 19 but showing the condition of the assembly when the carrier vehicle is moving on a short radius guideway turn.

FIGS. 19 and 20 show the upper ends of shafts 145 and 146 that journal the left turn control wheels 69 and 70 on the left turn wheel support member 73 and the upper ends of shafts 147 and 148 that journal the right turn control wheels 71 and 72 on the right turn wheel support member 74. They also show the upper end of a shaft 149 that journals the left side position control wheel 88 on the part 88 that extends rearwardly from the left end of the turn control member 81 and the upper end of a shaft 150 that journals a right side position control wheel on a corresponding part 151 that extends rearwardly from the right end of the turn control member 81.

FIGS. 19 and 20 also show a portion 152 of a support member that journals the support shaft 8 of the turn control member 81. Connections between the solenoids 83 and 84 and the turn control member are indicated by reference numerals 153 and 154. Also shown is a shaft 156 that is journaled by bearings carried by the base frame of the vehicle and that is connected through a universal joint connection 158 to the support shaft of the turn control member 81 and through a universal joint connection to corresponding support shaft of the rear bogie, insuring that both will operate in unison in the unlikely event that there should be a failure in energization of a solenoid of one of the bogies. Connection 158 is located in a vertical plane in approximate alignment with a horizontal line which is through the vertical axes of the shafts 149 and 150 that journal the turn control wheels.

FIGS. 19 and 20 also show the upper ends of the cam follower pins 77 and 78 that are carried by arms 75 and 76 and show slots 161 and 162 in the cam plate 80 through which such pins extend. The configuration of the slots 161 and 162 is such that front bogie is turned about its vertical turn axis in response to movement in guideway turns, acting to maintain the axes of the traction wheels in approximate alignment with the turn axis at all times. This operation is shown more clearly in FIG. 20 which shows the conditions of the parts shown in FIG. 19 when the vehicle is moving on a guideway turn having a short radius such as 20 feet for example.

Figure 21:
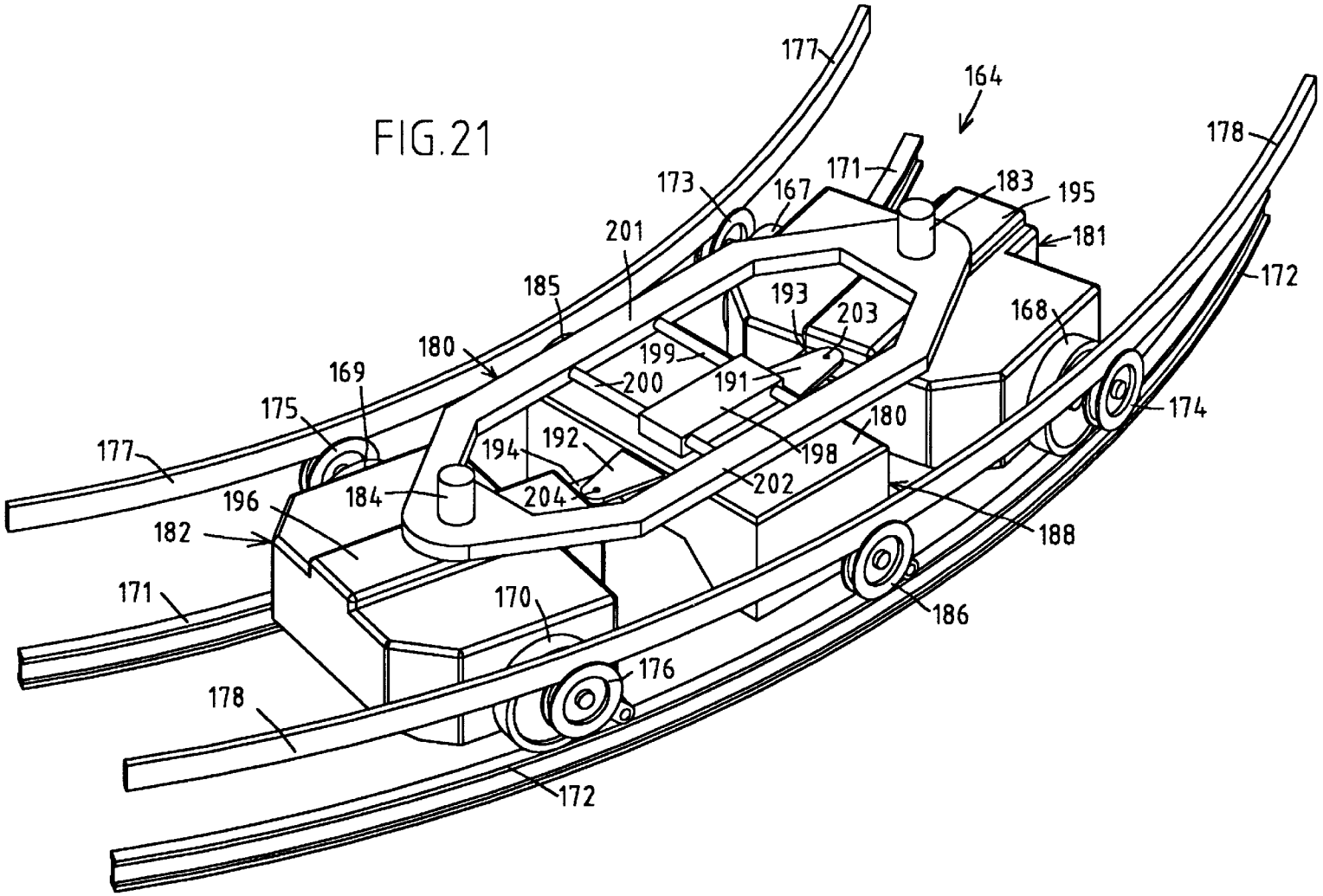
FIG. 21 is an isometric view of a carrier vehicle of the invention shown moving an a curved portion of a guideway.

FIG. 21 shows a carrier vehicle 164 supported on lower tracks of a guideway 166 that has upper tracks performing the functions of limiting upward and tilting movements of the vehicle 164, guiding its path of movement, controlling steering thereof through Y junctions and supplying electrical power thereto.

Vehicle 164 has front and rear pairs of left and right lower wheels 167, 168 and 169, 170 that are supported on left and right lower guideway tracks 171 and 172. Front and rear pairs of left and right upper wheels 173, 174 and 175, 176 of vehicle 164 so engage left and right upper guideway tracks 177 and 178 as to limit upward and tilting movements of the vehicle 164 and to also limit movement in a transverse direction. As shown, the upper tracks 177 and 178 engage in grooves in the upper wheels 173–176. Alternatively, the upper wheels may be formed to engage in grooves provided in the upper tracks but the use of grooved wheels has an advantage in simplifying the construction of the upper tracks and reducing costs thereof. In either case, the upper tracks limit transverse movement of the vehicle 164 and operate as ribs in guiding the vehicle and determining its path of movement.

The use of the upper tracks as guide ribs obviates any need for guide ribs on lower tracks, such as the guide ribs 67 and 68 of the track structures 33 and 34. This feature has the advantage of allowing existing railroad tracks to be used as part of the guideway, when feasible, and the spacing of the lower tracks and of the lower wheels preferably correspond to a standard spacing of railroad tracks (56.5 inches in the US). In some circumstances, it may be desirable to use of railroad tracks as portions of the guideway while also allowing use of such tracks for movement of standard railroad cars. In that case, it may desirable to provide outward spacings of the upper tracks 173–176 relative to the lower tracks 167–170 that are larger that those shown in the drawings. Also, in that case, a supporting structure for the upper tracks 173–176 may include a protective skirt to extend downwardly on the inside of upper portions of the upper wheels 173–176, to protect the upper tracks and wheels from the environment as much as possible. However, it generally preferred that a tubular support structure be provided that has a narrow slot and that is similar to the guideway 28 as shown in FIG. 4 and similar guideways shown in aforementioned applications and patents.

The carrier vehicle 164 is similar to the vehicle 46 in that it includes a main frame 180 supported on front and rear bogies 181 and 182 that support the front and rear pairs of lower and upper wheels 167–170 and 173–176 and that are journaled by the frame 180 for movement about front and rear vertical steering axes. Such axes are preferably in the same vertical plane as the horizontal axes of the lower wheels of the bogies and are aligned with the axes of the illustrated posts 183 and 184 which project upwardly for support of an automobile platform, passenger cabin or freight container, preferably using a standardized connection which is not shown but which corresponds to the connection 48 shown in FIG. 5.

In accordance with an important feature of the invention, an auxiliary pair of upper grooved wheels 185 and 186 are provided that are engageable with the upper tracks 173–176 and that control angles of turn of the bogie. Auxiliary wheels 185 and 186 are journaled by a carriage 188 for rotation about a transverse horizontal axis which is in a vertical plane approximately midway between the front and rear vertical steering axes. The carriage 188 has a frame structure which includes a housing 190 and tongues 191 and 192 that extend forwardly and rearwardly therefrom. Tongues 191 and 192 are connected to tongues 193 and 194 that extend rearwardly and forwardly from housings 195 and 196 which are part of frame structures of the front and rear bogies 181 and 182. An upwardly projecting portion 198 of the housing 190 of the carriage 188 is slidably supported on a pair of transversely extending horizontal shafts 199 and 200 that are secured at opposite ends to portions 201 and 202 of the main frame.

In operation, when the vehicle 164 is moving on a straight section of the guideway 166, connections between the tongues 191 and 192 and the tongues 193 and 194 are in a vertical plane aligned with the vertical turn axes of the bogies 181 and 182. The angular positions of the bogies are then such that the axes of the front and rear pairs of wheels are in parallel relation for straight line travel of the vehicle 164. However, the bogies 181 and 182 are automatically rotated about their vertical turn axes when the vehicle 164 moves onto a curved section of the guideway 166.

FIG. 21 shows a condition in which the vehicle 164 is on a portion of the guideway 166 that is curved to the left. In response to movement from a straight portion of the guideway and onto the curved portion and through the engagement of the auxiliary wheels 185 and 186 with the upper tracks 177 and 188, the wheels 185 and 186 have been moved outwardly or to the right, thereby positioning the carriage 188, its tongues 189 and 190 and the tongues 191 and 192 of the bogies outwardly or to the right, away from the center of curvature of the curved portion of the guideway. The front bogie 181 has then been rotated in a counterclockwise direction as viewed from above, away from the straight ahead neutral position while the rear bogie 182 has been rotated in a clockwise direction.

As a result, the bogies have been moved toward positions in which the horizontal axes of the wheels thereof are in alignment with the axis of curvature of the curved portion of the guideway 166. With proper positioning of the points of connection between the tongues, it is possible to obtain an alignment that is nearly exact for practical purposes.

In the illustrated arrangement, the points of connection are provided by pins 203 and 203 on the tongues 191 and 192 of the carriage 188 that extend downwardly through slots in the tongues 193 and 194 of the bogies 181 and 182.

The relationship between the radius of curvature of the guideway and the angles of turn of the bogies are determined in part by the distance between the turn axes which is preferably the wheel base when the horizontal axes of the lower wheels are in the same vertical planes as the turn axes, as is preferably the case. The angles of turn are also a function of the distances between the pins 203 and 204 and a central plane midway between the turn axes. As one example, the radius of curvature of the guideway may be 240 inches, as measured from a pint midway between the lower tracks 171 and 172, the wheel base may be 108 inches and the distances to the pins may be one-fourth the wheel base or 27 inches. In this example, an angle of turn of 12.2325 degrees of each of the bogies is obtained which differs by less than half a degree from the 12.6804 degrees that would be required for exact alignment. The length of the slots in the tongues 191 and 192 would need to be at least 0.62726 inches in this example, to accommodate the increase in distance of the pins from the turn axes of the bogies.

As second example, the distances from the central planes to the pins 203 and 204 may be increased by one inch from the 27 inches of the first example, to 28 inches. In this case, an angle of turn of each of the bogies is obtained which is equal to 12.6881, very nearly equal to the 12.6804 degrees that would be required for exact alignment.

The 28 inch distance in this example produces very nearly exact alignment, but may not be optimum. For example, it may be desirable to develop cornering forces to oppose the centrifugal forces developed when the vehicle is to move around turns of short radius and at speeds that are high in relation to any superelevation of the tracks. By changing the turn angles of the bogies, cornering forces of significant magnitude may be produced from interaction of the flanges of the wheels 173–176 with the upper tracks 177 and 178 combined with the interaction of the lower wheels 167–170 with the lower tracks 172. Such cornering forces may be increased in response to a decrease in the radius of a curve in the track, as by increasing the distance from the center plane to the front pin 203 and decreasing the distance to the rear pin 204. The pins need not be carried by the tongues 191 and 192 but may be carries by the tongues 193 and 194 with slots being then provided in the tongues 191 and 192. Many other changes in construction, geometry or distances may be effected, as desired.

For control of pressures applied to the upper tracks and for automated control of movement through Y junctions, mechanisms are provided within the housings 195 and 196 of the bogies 181 and 182 and within the housing 190 of the carriage. Such mechanisms are connected to supports for the upper wheels 173–176 of the bogies and to the supports for the auxiliary turn control wheels 185 and 186.

In automated control of movement through Y junctions, the upper wheels of the bogies and the auxiliary wheel on either the right or left side of the vehicle 164 are lowered to so that the wheels on the opposite side are in sole control of the path of movement of the vehicle. For example, in moving from an entrance of a Y junction to a right hand exit thereof, the left upper wheels 167 and 169 and the left auxiliary wheel 185 are lowered to positions well below the upper left track 177 while the right upper wheels 168 and 170 and the right auxiliary wheel 186 remain engaged with the upper right track 178 to control the path of movement, accurate control of the path being obtained using wheels on only one side.

Figure 22:
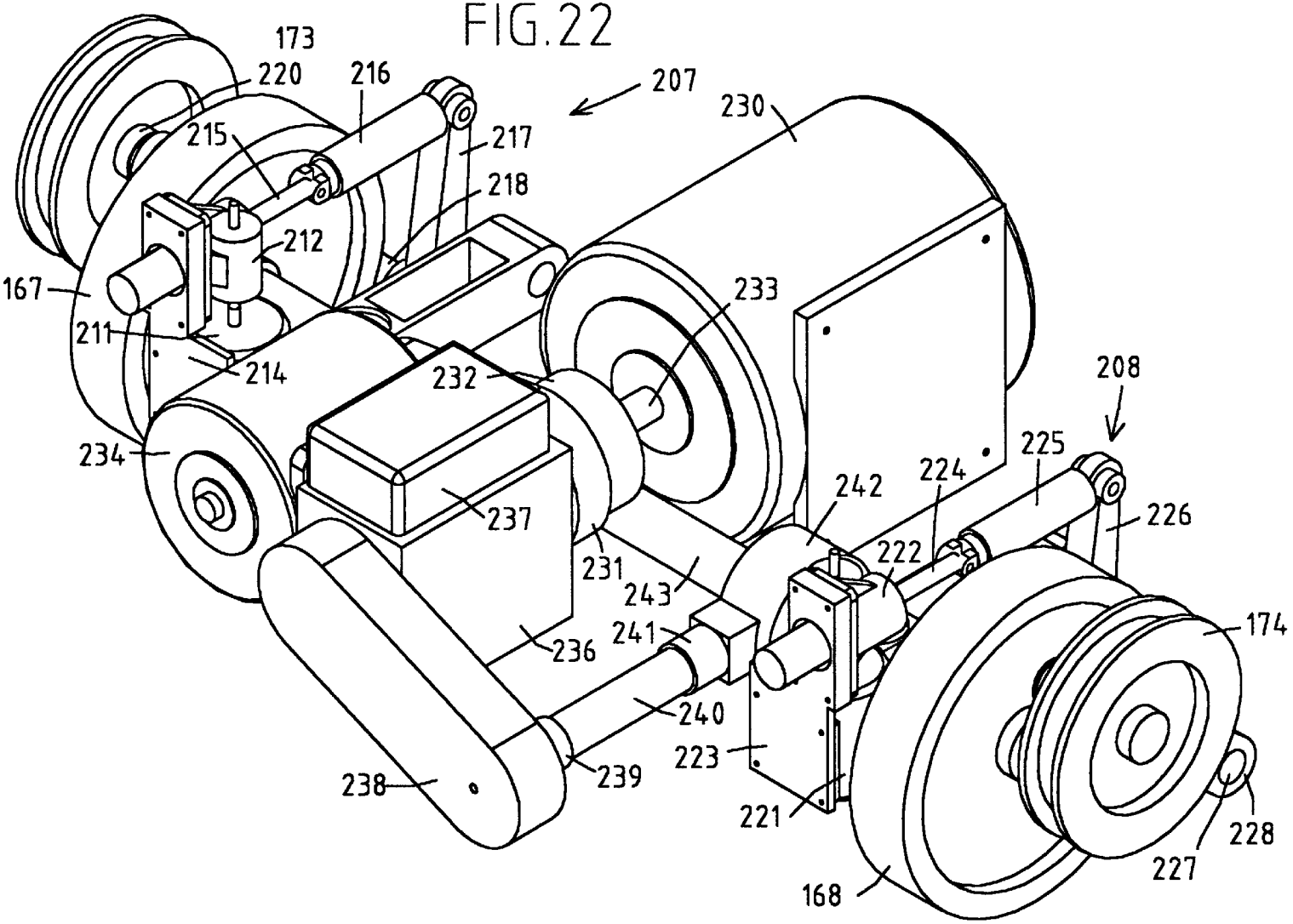
FIG. 22 is an isometric view showing mechanisms that are provided within the housing of a front bogie of the carrier vehicle of FIG. 21 for control of the upper front wheels thereof, also showing a drive train for drive of lower wheels of the vehicle.

FIG. 22 shows mechanisms 207 and 208 that are provided within the housing 195 of the front bogie 181 for control of the upper front wheels 173 and 174. Similar mechanisms are provided in the rear bogie 182 for control of the upper rear wheels 175 and 176 and in the carriage 188 for control of the auxiliary wheels 185 and 186. FIG. 22 also shows a drive train 210 for drive of the lower wheels 167 and 168.

The mechanism 207 includes a control motor 211 that drives a screw jack 212, both being mounted on a bracket 214 which is secured to frame structure of the bogie, not shown. A screw element 215 of the jack 212 is connected through a compression spring unit 216 to the upper end of a control arm 217 that has a lower end secured to an inner end of a horizontal shaft 211. An outer end of shaft 218 is connected to the lower end of support arm structure 220 for the wheel 173. The control motor 211 is operable in one direction to move the screw element 215 to the left as viewed in FIG. 22, thereby rotating the arm 217 and shaft 218 in a counter-clockwise direction to move the wheel 173 to a position well below the upper left track 177.

A similar mechanism is provided for control of the upper right wheel 174, including a control motor 221 and a jack 222 mounted on a bracket 223. A screw element 224 of the jack 222 is connected through a compression spring unit 225 to the upper end of a control arm 226 having a lower end secured to the inner end of a. shaft 227. The outer end of the shaft 227 is secured to a support arm structure 228 for the upper right wheel 174.

The drive train 210 includes a main motor 230 and a power divider unit 231 which is coupled through an electrically operable clutch and brake unit 232 to a shaft 233 of the motor 230 and is which is also coupled to the shaft of a control motor 234. The unit 231 includes a planetary gearing assembly having a sun gear coupled to clutch and brake unit 231, a ring gear coupled through a drive chain to the shaft of the control motor 234 and planet gears on a carrier which is coupled to an input shaft of a transmission 236.

The main motor is advantageously an induction motor of a standard type which has a disadvantage in that it is effectively limited to operation within a narrow speed range close its synchronous speed which is 3600 RPM in the case of a two pole motor supplied with 60 Hz current. However, such a motor is efficient, rugged and reliable in operation with other advantages. It can be directly connected to a conventional AC power lines and when so connected it can be operated as a generator to return energy to the AC power lines when driven at above synchronous speed. The control motor 234 is preferably a wound field reversible DC motor that can operate as a generator as well as a motor. The transmission 36 is preferably a synchromesh transmission similar to a standard manual transmission but modified to include electric motor units that are in a housing portion 237 of the transmission and that operate shift forks of the transmission.

The combination of the control motor 234 with the power divider unit 231 and transmission 236 permits highly efficient use of an induction motor connected to conventional power lines, in spite of its speed limitations. In the operation of the system, the vehicle 164 is operated at a substantially constant speed most of the time during which almost all power is supplied by the main motor operating efficiently at close to its rated speed with extremely little power is handled by the control motor 234. It is only during acceleration and deceleration of the vehicle 164 that a substantial power is handled by the control motor 234 and, even then, the portion of power transferred by the control motor 234 is only a fraction of that being transferred by the main motor 230. Moreover, a substantial portion of the energy required for acceleration or for operation of the control motor may be returned to the AC power source either through operation of the main motor 230 as a generator or through use of an inverter. The result is that high overall efficiency is obtained.

An output shaft of the transmission 236 is coupled through a drive chain and sprockets in a housing 238 and through a universal joint 239 to one end of a drive shaft 240. The opposite end of the drive shaft 240 is coupled through a universal joint 241 to an input shaft of a differential gear assembly in a housing 242. Output shafts of the differential gear assembly are coupled to the lower front wheels 167 and 168 through shafts in shaft housings 243 and 244.

Figure 23:
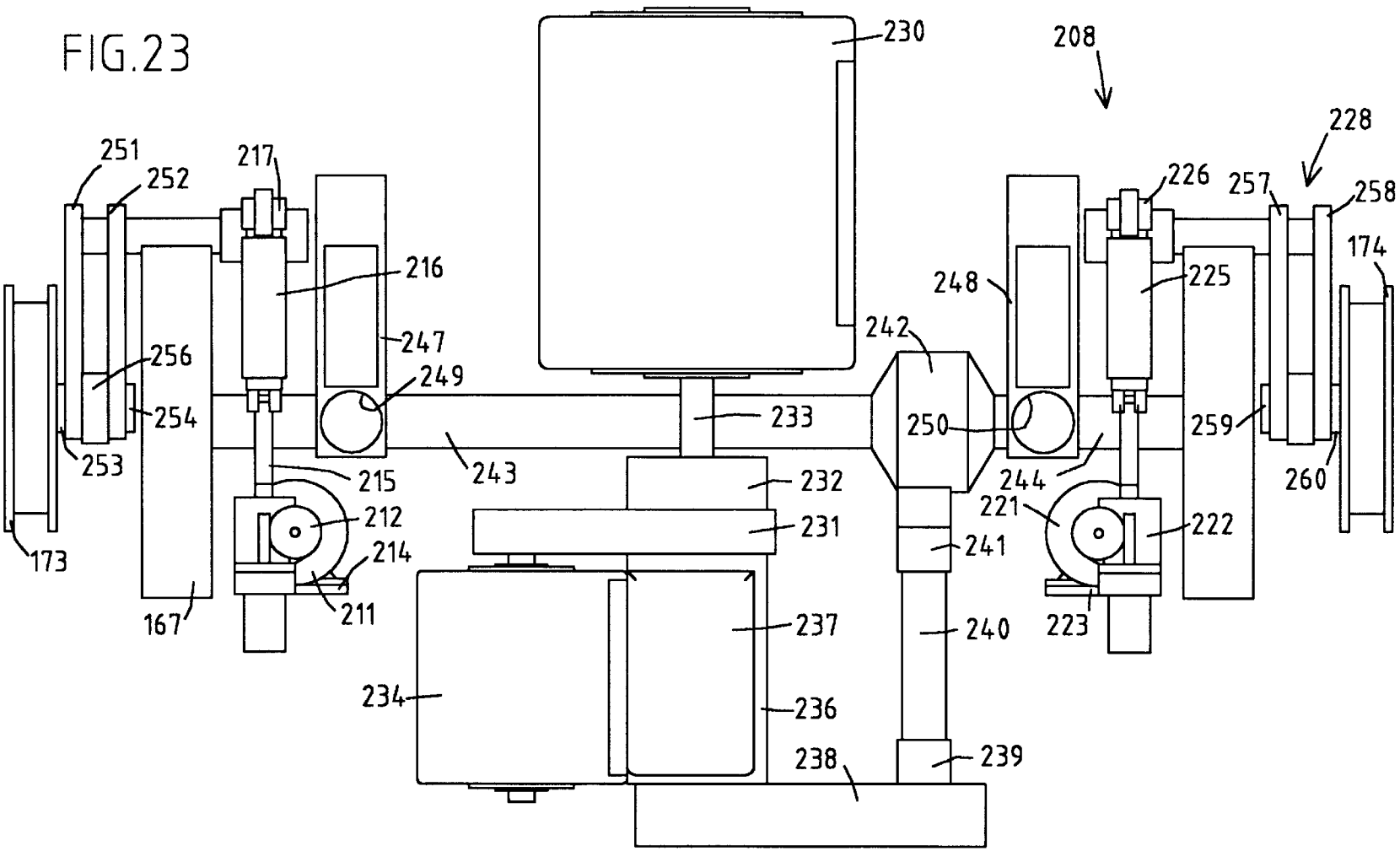
FIG. 23 is a top plan view of the mechanisms and drive train shown in FIG. 22.

Connections are provided between the shaft housings 243 and 244 and rearward ends of a pair of control arms 247 and 248, arm 248 being visible only in the plan view of FIG. 23. The frame structure of the bogie is not shown but it includes shafts that journal the forward ends of the control arms 247 and 248 for rotation about a horizontal axis. Compression spring and shock absorber units, also not shown, have lower ends seated in sockets 249 and 250 that are provided in the rearward ends of the control arms 247 and 248 as best shown in the plan view of FIG. 23. The upper ends of such units engage portions of the frame structure of the bogie for support thereof. The gear housing 242 and the shaft housings 243 and 244 form a rigid assembly but the connections to the control arms 247 and 248 are such as to vertical and tilting movements of the assembly during compression and expansion of the spring units.

Figure 25:
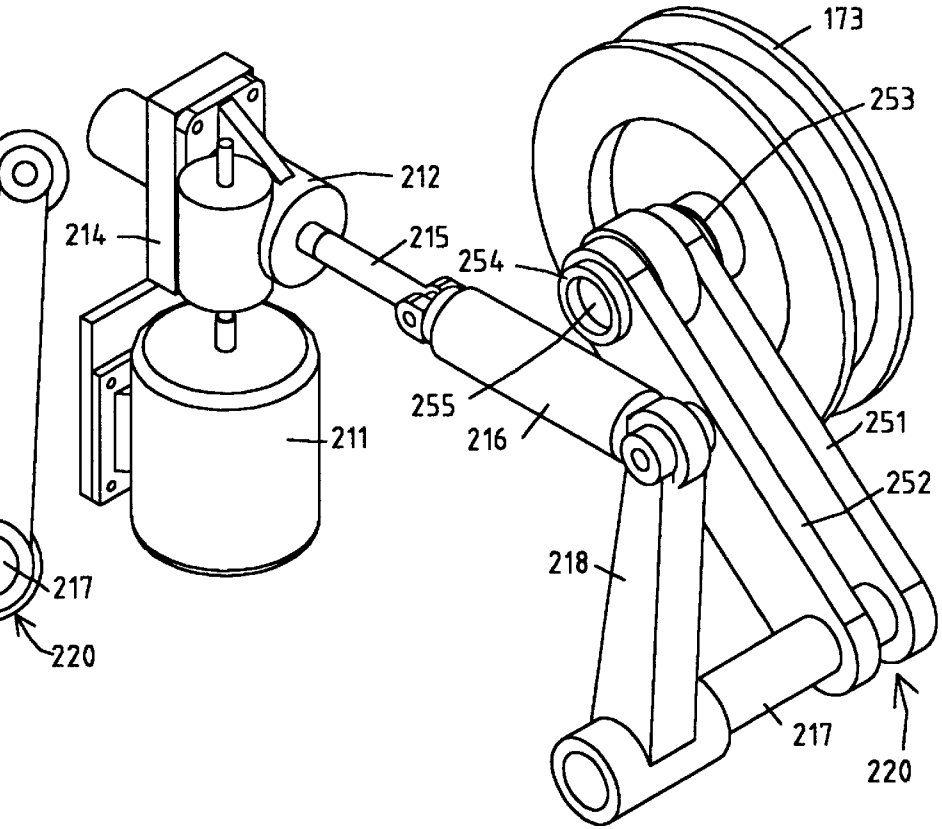
FIGS. 24 and 25 are side elevational and isometric views of one of the upper wheel control mechanisms shown in FIGS. 22 and 23.
Figure 24:
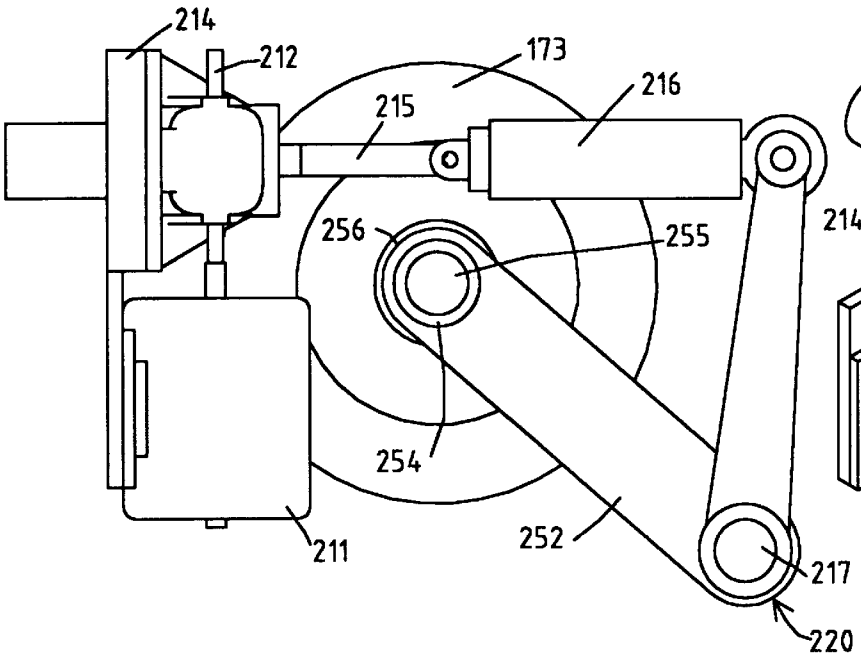

It should be understood that extensions of the shafts 218 and 227 of the mechanisms 207 and 208 are provided and are supported and journaled by the frame structure of the bogie. Such shaft extensions are not shown in the drawings, but the plan view of FIG. 23 and the side elevational and isometric views of FIGS. 24 and 25 are provided to more clearly show certain features of construction of the mechanisms 207 and 208, particularly with regard to the construction of the support arm structures 220 and 228 which support the grooved wheels 173 and 174 from the shafts 218 and 227.

The support arm structure 220 includes a pair of spaced parallel arms 251 and 252 that have ends secured to the shaft 217. Bearings 253 and 254 are provided in aligned openings in opposite ends of the arms 251 and 252 to journal a support shaft assembly 255 for the grooved wheel 173 while a slip ring assembly 256 is provided between the arms 251 and 252 and in surrounding relation to the support shaft assembly. The support shaft assembly includes outer portions of insulating material that are journaled by the bearings 253 and 254 and an inner metal portion which is connected to the grooved wheel to which an electrical connection is provided through the slip ring assembly 256. Electrical connections ore not shown but it will be understood a suitable flexible cable is provided for connection of the wheel 173 to motors and circuitry of the vehicle.

The support arm structure 228 for the wheel 174 has a construction like that of the support arm structure 220 for the wheel 173. It includes parallel arms 257 and 258, bearings 259 and 260 and a slip ring assembly 262. As described previously, mechanisms that are similar to the mechanisms 207 and 208 are provided in the rear bogie 182 for control of the upper rear wheels 175 and 176 and in the carriage 188 for control of the auxiliary wheels 185 and 186.

Figure 26:
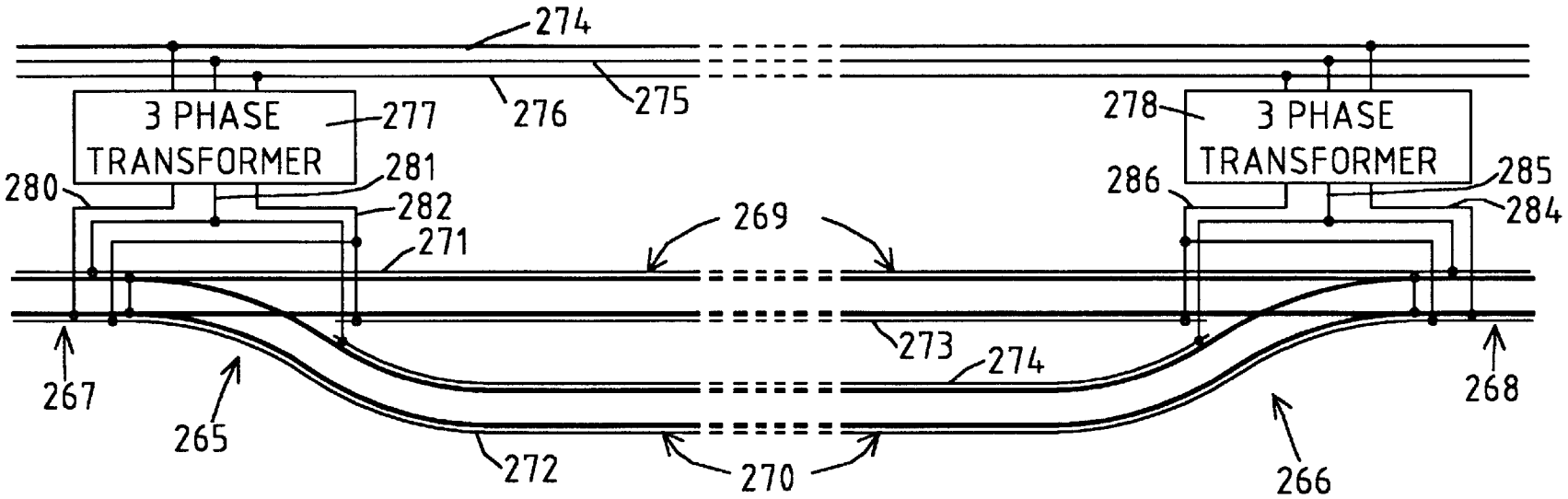
FIG. 26 is a schematic diagram portions of a guideway that include Y junctions, also showing the supply of three phase power thereto.

FIG. 26 illustrates Y junctions of and the supply of three phase power to tracks of the guideway. Two Y junctions 265 and 266 are shown. The Y junction 265 has a single entrance at an end of a guideway portion 267 and left and right exits while the Y junction 266 which has left and right entrances and a single exit at an end of a guideway portion 268. Guideway portions 269 and 270 are shown extending from the left and right entrances of junction 266 to the left and right entrances of the guideway portion.

Before entering the Y junction 265, the grooved wheels on one side of the vehicle 164 must be lowered while those on the opposite side of the vehicle are up. If the wheels on the left side are up, they will engage an upper left track 271 which is shown extending as one continuous track along the guideway portion 270, the Y junction 265, the guideway portion 269, the Y junction 266 and the guideway portion 268 to guide the vehicle therealong. If the wheels on the right side are up, they will engage an upper right track 271 which is shown extending as one continuous track along the guideway portion 270, the Y junction 265, the guideway portion 270, the Y junction 266 and the guideway portion 268 to guide the vehicle therealong.

An additional upper track 273 is shown along the right side of an end portion of the left exit of the Y junction 265, the right side of the guideway portion 269 and an end portion of the left entrance of the Y junction 266. Another additional upper track 274 is shown along the left side of an end portion of the right exit of the Y junction 265, the left side of the guideway portion 270 and an end portion of the left entrance of the Y junction 266. Use of these additional upper tracks 273 and 274 is not necessary for guidance of the vehicle, but grooved wheels may be elevated for engagement therewith for traction control and for insuring sufficient supply of current to vehicles. If wheels are so elevated, they must be lowered before reaching the end of the Y junction 266 to be again elevated after moving beyond the exit of the Y junction 266.

For supply of power, a single phase supply or a DC supply might be used with one terminal connected to the lower tracks and the other connected to the upper tracks. However, the use of a three phase supply has important advantages including the availability high power motors. In the system as shown in FIG. 26, three-phase step-down transformer units are provided along the length of the guideway and have primary windings connected high line wires 274, 275 and 276. Two of such transformers 277 and 278 are shown in FIG. 26 with connections at the two Y junctions 265 and 266. Transformer 277 has an output line 280 connected to lower tracks of the guideway, an output line 281 connected to the upper tracks 271 and 274 and an output line 282 connected to upper tracks 272 and 273. The same tracks are shown connected to output lines of transformer 278 which may not be necessary if the Y junctions 265 and 266 are close together. Transformers should be provided at points along the guideway only as justified by considerations with respect to reliability, capital costs and operating expense, taking into account energy losses from current flow through the tracts. As shown, however, transformer 278 has output line 284 connected to lower tracks of the guideway, an output line 285 connected to the upper tracks 271 and 274 and an output line 282 connected to upper tracks 272 and 273.

It should be noted that when the grooved wheels on one side of a vehicle are lowered for movement through a Y junction, only single phase current is supplied thereto. This fact does not present a serious problem with respect to three phase induction motors which will operate with only current to only one phase winding thereof, once started and operating at near rated speed. However, this fact should be taken into account in operating the vehicles and in designing guideways, particularly with respect to minimizing current requirement when moving through Y junctions.

Figure 27:
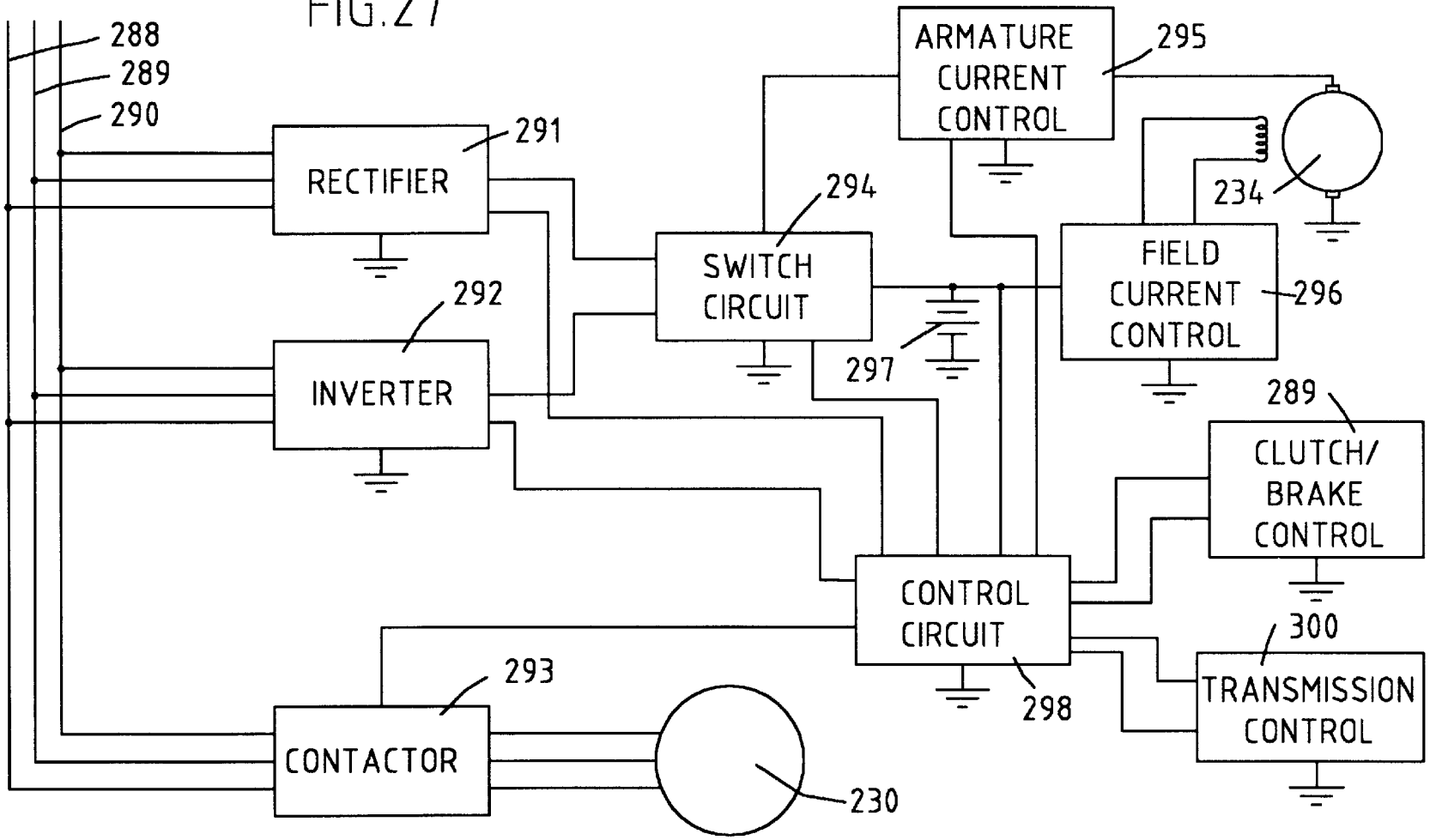
FIG. 27 is a schematic diagram of electrical circuitry of the carrier vehicle of FIGS. 21–25.

FIG. 27 is a diagram of circuitry of the vehicle. Supply lines 288, 289 and 290 which are connected to the lower wheels, the left upper wheels and the right upper wheels of the vehicle are connected to inputs of a rectifier 291, outputs of an inverter 292 and through a contactor 293 to the main motor 230. A switch circuit 294 is provided, connected to the output of the rectifier 291, the input of the inverter 292 and through an armature current control circuit 295 to the armature of the control motor 234. The switching circuit 294 is also connected to a circuit 296 for control of the field current of control motor 234 and also to a battery 297 and to a control circuit 298 for supply of operating current thereto.

The control circuit 298 supplies control signals to the circuits 291–296 and also to circuits 299 and 300 which control clutch/brake unit 232 and the transmission 236. With regard to operation of the drive train 210, the clutch/brake unit 232 can be placed in a clutch condition in which the sun gear of unit 231 is coupled to the shaft 233 of motor 230, a brake condition in which the sun gear of unit 231 is braked and a neutral condition in which the sun gear is neither clutched to shaft 233 nor braked.

At any time when the unit 232 is in its neutral condition, the contactor 293 may be used to start the main motor 230 under a no-load condition and operation thereof at a speed close to its rated speed which may be 3550 RPM in the case of a two pole 60 Hz motor or 1780 RPM in the case of a four pole 60 Hz motor, for example. It is thereafter operated at a speed close to its rated output speed at all times.

The neutral condition of unit 232 may also be used in effecting certain changes in the mode of operation of the control motor 234 before operating the unit 232 to its clutch condition. In such mode-change operations, the planet carrier and the input shaft of the transmission 236 may be rotating and it is desirable that the speed of the sun gear of unit 231 be changed to be equal to that of the shaft 233 of motor 230, before operating the unit 232 to the clutch condition. With the unit 232 in the neutral condition and the planet carrier rotating at any given speed, the control motor 234 may be used to quickly change the speed of the sun gear to that of the main motor shaft 233.

In the brake condition of unit 232, the control motor 234 may be used alone to drive the vehicle through the transmission 236, usually with the first gear thereof, when accurate positioning of the vehicle is desired or to accelerate the vehicle to a relatively low speed.

Shifting between gears of the transmission can and preferably is effected with the unit 232 in its clutch condition but not before the control motor is so operated as to prevent any transmission of torque between the input shaft of the transmission 236 and the planet carrier of the unit 231. In a preferred type of gear shift operation, the control motor 234 is operated to condition in which no torque is applied therefrom or thereto, then the shift fork of the transmission 236 may then be operated to a neutral position, and then the control motor is rapidly accelerated or decelerated to a condition at which the input shaft of the transmission is rotating at a speed at which substantially no change in the speeds of gears will result from shifting of a desired shift fork.

As an example of operation of the drive train 210, a target top speed of 80 MPH may be assumed and it may also be assumed that a speed of 20 MPH may be reached while using the first gear of the transmission 236, while operating the main motor 230 at a rated speed of 3550 RPM and while operating the control motor 234. The first gear may be used in accelerating the vehicle from a stopped condition to 30 MPH. Initially, the control motor 234 may be used alone to accelerate to 10 MPH with the unit 232 in its brake condition, the motor 234 preferably being so operated through control of field and armature currents as to gradually reduce its torque to zero as that speed is approached and avoid any abrupt change in acceleration. Then the unit 232 is placed in its neutral condition, the operation of the control motor 234 is reversed and the sun gear of the unit 231 is accelerated from zero to the no-load speed of the main motor which may be between 3550 and 3600 RPM. Then the unit 232 is operated to its clutch position. Then from 10 MPH to 20 MPH the control motor 234 is operated as a generator while gradually reducing its speed to zero. From 20 to 30 MPH the control motor 234 is again operated as at motor, its speed being effectively added to the speed of the main motor in determining the output speed.

At 30 MPH in this example, a shift to the second gear is effected, preferably in the manner as previously described. During the gear shift operation, the operation of the control motor 234 is changed from being at a high speed in one direction of rotation to being at a high speed in the opposite direction. After the gear shift operation, the control motor 234 is operated as a generator until reaching a speed of 40 MPH and then as a motor until a speed of 50 MPH, whereupon a shift to the third gear is effected, the third gear being used in the same manner until a speed of 70 MPH is reached, whereupon a shift to the fourth gear or direct drive is performed. From 70 MPH to 80 MPH, the control motor 234 is operated as a generator. In the fourth gear, however, it may be operated as a motor. For example, operation as a motor may be required to maintain a proper following distance behind a vehicle ahead when facing a head wind or climbing a grade.

When the control motor 234 is operated as a motor, the required power may be supplied from the rectifier 291 and/or from the battery. When the control motor 234 is operated as generator, the power generated thereby may be dissipated in a resistive load but is preferably used in charging the battery and/or in returning power to the AC source though the inverter 292. When the speed of the control motor approaches zero, the use of resistive load may be necessary, but the magnitude of the lost energy is then quite small.

In deceleration from 80 MPH to 70 MPH, the main motor 230 may be driven from the vehicle wheels and through the drive train to be operated at above synchronous speed and to operate as a generator returning energy to the AC power line. During such an operation, the control motor 234 may be operated as a motor but the required power may also be returned to the AC line through the operation of the main motor 230 as a generator. Thus the control motor 234 is used in combination with the power divider unit 231 and transmission 236 to obtain highly efficient use of the induction motor 234 connected to conventional power lines, in spite of its speed limitations. It is noted that although the motor 230 is a three phase induction motor in the illustrated system, a single phase induction motor might be used to obtain many of same advantages.

All vehicles moving in any particular part of the guideway should be operated at substantially the same speed to follow one another at a safe following distance. Different target speeds may be established for different portions of a guideway along its length but for maximum efficiency, each target speed should be that obtained with one of the gears of the transmission when the speed of the control motor 234 is close to a zero speed.

It will be understood that modifications and variations may be effected without departing from the spirit and scope of the novel concepts of this invention.

What is claimed is:

1. A transportation system, comprising: a plurality of carrier vehicles, a guideway for guiding said carrier vehicles for movement therealong, and track means supported by said guideway and arranged for connection to terminals of an electrical power source, said track means including a pair of metallic electrically conductive left and right lower tracks and a pair of metallic electrically conductive left and right upper tracks, track support means for supporting said tracks from said guideway, each of said carrier vehicles including electrically powered drive means for coaction with said guideway for effecting movement of said carrier vehicle along said guideway, front and rear pairs of left and right lower wheels for engagement with said pair of left and right lower tracks for support of said vehicle, front and rear pairs of left and right upper wheels engageable with said upper tracks to restrict rocking movements of said carrier vehicles, pressure applying means for urging said upper wheels into pressure engagement with said upper tracks, said wheels including metallic peripheral portions for electrically conductive engagement with said tracks, and conduction means for electrically connecting said metallic peripheral portions of said wheels to terminals of said electrically powered drive means of said vehicle, said track support means including insulation means to allow conduction of current between said terminals of said source of electrical power and said terminals of said electrically powered drive means of said vehicle, said current being conducted through said tracks and through said metallic peripheral portions of said wheels and said conduction means, said electrical power source being a source of three phase AC current having first, second and third terminals, said electrically powered drive means including a three phase AC motor having first, second and third terminals, and said track means being so connected to said terminals of said source and said conduction means being so arranged as to allow said conduction of current between said first, second and third terminals of said source and said first, second and third terminals of said AC motor.

2. A transportation system as defined in claim 1 wherein said upper tracks are independently connected to said first and second terminals of said source and wherein at least one of said pair of lower tracks is connected to said third terminal of said source.

3. A transportation system as defined in claim 2, wherein said guideway includes a plurality of Y junctions including junctions of a first type that allow movement of vehicles from a single entrance to either of two left and right exits and junctions of a second type that allow movement of vehicles from either of two left and right entrances to a single exit, each of said Y junctions including upper left and right upper track portions connected to said first and second terminals of said source, said left track portion of each junction being effective for supply of single phase current at times during movement of a vehicle when said right track portion is not engaged by an upper right wheel or a vehicle, and said right track portion of each junction being effective for supply of single phase current at times during movement of a vehicle through a Y junction when said left track portion is not engaged by an upper left wheel of a vehicle.

4. A transportation system, comprising: a plurality of carrier vehicles, a guideway including a pair of lower track structures having upwardly facing surface portions for supporting said carrier vehicles for movement and a pair of upper track structures having downwardly facing surface portions for limiting upward and tilting movements of carrier vehicles, each of said carrier vehicles including front and rear pairs of left and right lower wheel means including wheels journaled on horizontal axes and having annular surface portions for engaging said upwardly facing surface portions of said lower track structures and front and rear pairs of left and right upper wheel means including wheels journaled on horizontal axes and having annular surface portions for engaging said downwardly facing surface portions of said upper track structures, each of said upper track structures having inwardly and outwardly facing surface portions and each of said upper wheel means including surface portions engageable with said inwardly and outwardly facing surface portions of said upper track structures to limit transverse movement of said front and rear upper wheel means relative to said upper track structures, whereby said inwardly and outwardly facing surface portions of said upper track structures operate as guiding rib means in controlling the path of movement of vehicles along said guideway while said downwardly facing surface portions of said upper track structures operate to limit both upward and tilting movements of said carrier vehicles.

5. A transportation system as defined in claim 4, each of said carrier vehicles comprising frame means and front and rear bogies journaling said front and rear pairs of left and right lower wheel means and said front and rear pairs of left and right upper wheel means, said bogies being journaled by said frame means for angular movements about vertical turn axes, and direction control means operative in controlling angular positions of said bogies about said vertical turn axes thereof.

6. A transportation system as defined in claim 5 wherein said direction control means include left and right turn control wheel means having surface portions engageable with portions of said pair of upper structures.

7. A transportation system as defined in claim 6 wherein said direction control means include support means for said left and right turn control wheel means, said support means being supported by said vehicle frame means for transverse movement relative thereto.

8. A transportation system as defined in claim 7, said left and right turn control wheel means comprising a pair of left and right wheel means supported by said support means on a common horizontal axis approximately located in a vertical plane midway between said front and rear vertical turn axes, means connecting said transversely movable support means to said front and rear bogies at points approximately midway between said vertical plane and said front and rear vertical turn axes.

9. A transportation system as defined in claim 5, said inwardly and outwardly facing surface portions of said upper track structures being engaged with said surface portions of said upper wheel means in regions that are in transverse alignment with vertical turn axes of said bogies.

10. A transportation system as defined in claim 4, wherein said guideway includes a plurality of Y junctions and wherein each of said carrier vehicles includes control means for controlling movements through said Y junctions, said control means including means for selectively lowering said front and rear upper wheel means on either side thereof to position said surface portions of said front and rear upper wheel means into inoperative positions out of engagement with the corresponding surface portions of said upper track structures to allow sole control of said path of movement through engagement of surface portions of said front and rear upper wheel means on the opposite side thereof with the corresponding surface portions of said upper track structures.

11. A transportation system as defined in claim 10 wherein said Y junctions include junctions of a first type that allow movement of vehicles from a single entrance to either of two left and right exits and junctions of a second type that allow movement of vehicles from either of two left and right entrances to a single exit, said lower track structures including left and right lower track structures in all portions of said guideway and additional lower track structures in said Y junctions that cooperate with said left and right lower track structures to provide substantially continuous support of vehicles moving through said Y junctions, and said upper structures including left and right upper track structures in said Y junctions that have surface portions which are selectively engageable by surface portions of said left and right upper wheel means of said vehicles in guiding movements of vehicles through said Y junctions.

12. A transportation system as defined in claim 11 wherein said left and right upper track structures in said first type of Y junction are usable to guide movement of vehicles from said entrance thereof to either of said left and right exits thereof, and wherein said left and right upper track structures in said second type of Y junction are usable to guide movement of vehicles from either of said entrances thereof to said exit thereof.

13. A transportation system as defined in claim 12 wherein said additional track structures in each of said junctions of said first type include portions that extend from left track structures at said entrances to left track structures at said right exits and portions that extend from right track structures at said entrances to right track structures at said left exits, said additional track structures in each of said junctions of said second type including portions that extend from right track portions at said left entrances to right track structures at said exits and portions that extend from left track structures at said right entrances to left track structures at said exits.

14. A transportation system as defined in claim 4, said upper track structures including tracks that have lower end surface portions defining said downwardly facing surface portions and that have side surface portions which provide said inwardly and outwardly facing surface portions, and said wheels of said left and right upper wheel means being formed with annular grooves which provide said annular surfaces for engaging said downwardly facing surface portions and which provide side surface portions engageable with said side surface portions of said tracks to limit said transverse movement of said upper wheels and of said front and rear bogies.

15. A transportation system as defined in claim 4, further comprising controllable pressure applying means for urging said annular surface portions of said left and right upper wheel means into engagement with said downwardly facing surface portions of said upper track structures.

16. A transportation system, comprising: a plurality of carrier vehicles, a guideway including track means for supporting and guiding said carrier vehicles and including means operable as guiding rib means for guiding said vehicles in movement along said track means, each of said vehicles including a frame, front and rear bogies journaled on said frame for movement about front and rear turn axes, each of said bogies having left and right wheel means for engaging said track means, carriage means supported from said frame for movement in a transverse direction, engagement means on said carriage means for engagement with said guiding rib means, front tongue means projecting rearwardly from said front bogie, rear tongue means projecting forwardly from said rear bogie, front and rear connection means on said carriage means for connection to said front and rear tongue means of said bogies, said carriage means being moved in a transverse direction in response to engagement between said engagement means and said guiding rib means when moving onto a curved portion of said guideway to rotate said bogies through said connection means and said tongue means and to move horizontal axes of said wheel means toward alignment with the center of said curved portion of said guideway.

17. A transportation system as defined in claim 16 wherein the longitudinal spacings between said connection means and said turn axes of said bogies are each equal to approximately one-half of the longitudinal distance between said turn axes and said engagement means.

18. A transportation system as defined in claim 17 wherein said engagement means are located in a transverse plane mid-way between said turn axes of said bogies, whereby the longitudinal spacings between said connection means and said turn axes of said bogies are each equal to approximately one-fourth the longitudinal distance between said turn axes.

19. A transportation system as defined in claim 16, wherein said guiding rib means include left and right guiding rib means along left and right portions of said track means, said engagement means including left and right engagement means for engagement with said left and right guiding rib means, and means for selectively controlling engagement between said left and right engagement means and said left and right guiding rib means.

20. A transportation system comprising: a plurality of carrier vehicles, a guideway for including track means for supporting said carrier vehicles for movement therealong and including conductors along said guideway for conducting AC power at a fixed frequency between utility power lines and carrier vehicles moving along said guideway, each of said carrier vehicles having wheels engaging said track means and drive means for said wheels, each of said drive means including induction motor means for connection to said conductors to rotate at a substantially constant speed, variable speed motor means, and coupling means for coupling said induction motor means and said variable speed motor means to said vehicle wheels through a differential gearing unit operative to divide power between said induction motor means and said variable speed motor means, said variable speed motor means being operative at high speeds only when accelerating and decelerating said vehicle and being normally operative at a speed nearly equal to zero whereby substantially all of the power applied to said wheels is supplied by said induction motor means.

21. A transportation system as defined in claim 20 wherein said coupling means includes a multi-speed transmission that is shiftable to provide a number of gear ratios for allowing efficient acceleration and deceleration and for allowing constant and efficient operation of said vehicle at any one of number of substantially constant speeds.

22. A transportation system as defined in claim 21 including a clutch and brake unit having clutch position in which an element of said differential gearing is connected to said induction motor means, a brake position in which said element is braked and a neutral position in which said element is free to rotate and in which said variable speed motor means is usable to facilitate shifting of the gear ratio of said transmission.

23. A transportation system comprising: a plurality of carrier vehicles, a guideway including tracks for supporting said carrier vehicles for movement therealong and including conductors along said guideway for conducting AC power at a fixed frequency between utility power lines and carrier vehicles moving along said guideway, each of said carrier vehicles including a pair of left and right drive wheels engaging said tracks and drive means for driving said left and right drive wheels, each of said drive means including induction motor means for connection to said conductors to be constantly and efficiently operated during vehicle operation at a speed close to a synchronous speed determined by the number of its poles and said fixed frequency, a main differential gearing assembly coupled to said pair of left and right wheels, a multi-speed transmission having a plurality of fixed gear ratios, coupling means for transfer of power between said induction motor means and said main differential gearing assembly through said multi-speed transmission, said coupling means being operable to allow changes in the speed of said vehicle between a zero speed and speeds determined by said fixed gear ratios and while normally operating the vehicle at a substantially constant speed with almost all vehicle drive power being supplied by said induction motor means operating efficiently at close to said synchronous speed.

24. A transportation system as defined in claim 23, wherein each of said carrier vehicles includes a main frame structure, and front and rear bogies supporting said frame structure and connected thereto for pivotal movement about front and rear vertical steering axes, said bogies including support wheels on horizontal axes that approximately intersect said vertical steering axes with said left and right drive wheels being provided by support wheels of one of said bogies that includes said main differential gearing assembly, induction motor means, multi-speed transmission and coupling means, said induction motor means and said multi-speed transmission being supported in said one of said bogies along common central longitudinal axis intersecting said steering axis of said one of said bogies and on opposite sides of the axis of said drive wheels, and said coupling means including a drive shaft extending in a longitudinal direction and connected at one end to an input shaft of said differential gearing assembly and a drive chain and sprocket assembly coupling an opposite end of said drive shaft to and output shaft of said multi-speed transmission.

25. A transportation system as defined in claim 23 wherein said coupling means includes variable speed motor means and an auxiliary differential gearing unit coupled between said induction motor means and said variable speed control means and said main differential gearing assembly and operative to divide power between said induction motor and said variable speed control means, said variable speed control means being operative at high speeds only when accelerating and decelerating said vehicle and being normally operative at a speed nearly equal to zero whereby substantially all of the power supplied to said drive wheels is supplied by said induction motor means.

26. A transportation system as defined in claim 25, wherein said variable speed control means comprises a variable speed motor.

27. A transportation system as defined in claim 25 including a clutch and brake unit having clutch position in which an element of said auxiliary differential gearing unit is connected to said induction motor means, a brake position in which said element is braked and a neutral position in which said element is free to rotate and in which said variable speed motor means is usable to facilitate shifting of the gear ratio of said multi-speed transmission.

* * * * *